US006916355B2

(12) United States Patent
Kida et al.

(10) Patent No.: US 6,916,355 B2
(45) Date of Patent: Jul. 12, 2005

(54) COMPOSITE MATERIAL AND METHOD FOR PRODUCTION OF THE SAME

(75) Inventors: Masahiro Kida, Aichi-prefecture (JP); Takahiro Ishikawa, Toyoake (JP); Masayuki Shinkai, Aichi-prefecture (JP); Takatoshi Ikematsu, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 370 days.

(21) Appl. No.: 10/299,593

(22) Filed: Nov. 19, 2002

(65) Prior Publication Data

US 2003/0127212 A1 Jul. 10, 2003

(30) Foreign Application Priority Data

Nov. 22, 2001 (JP) ..... 2001-358459
Nov. 11, 2002 (JP) ..... 2002-327153

(51) Int. Cl.[7] ..... B22F 7/00
(52) U.S. Cl. ..... 75/230; 419/5; 419/10; 419/13; 419/14; 419/19; 419/45; 428/545
(58) Field of Search ..... 75/230; 428/545; 419/5, 10, 13, 14, 19, 45

(56) References Cited

U.S. PATENT DOCUMENTS 5,000,248 A 3/1991 Newkirk et al.
5,366,686 A * 11/1994 Mortensen et al. ..... 419/5
2002/0051724 A1 5/2002 Kida ..... 791/147

FOREIGN PATENT DOCUMENTS

JP 1-273659 11/1989
JP 2-240227 9/1990
JP 05-009009 1/1993
JP 09-227969 9/1997
JP 3107563 9/2000
JP 2002-47519 2/2002

OTHER PUBLICATIONS

Tae Yound Um and Ryuzo Watanabe, "*Production of Al/TiAl$_3$ Composite by in–situ Infiltration–Combustion Synthesis*," J. Japan Inst. Metals, vol. 58, No. 5 (1994), pp. 559–563.

Keizo Kobayashi, et al., *Consolidation of Titanium Tri–aluminide using by Spark Plaza Sintering*, Powder and Powder Metallurgy, vol. 44, No. 6, pp. 554–559.

* cited by examiner

*Primary Examiner*—Ngoclan T. Mai
(74) *Attorney, Agent, or Firm*—Burr & Brown

(57) ABSTRACT

A composite material 5 in which a dispersing material 7 is dispersed in a matrix 6 is provided. The composite material 5 is producible by steps of filling said mixed material in a space forming region to be defined by at least two container elements when said at least two container elements are integrated into one body, and then infiltrating said aluminum (Al) being molten due to heat generated by said self-combustion reaction into pores inside said mixed material through at least one hole formed in an upper part of a reaction container formed by combining said at least two container elements in which said mixed material is filled in said space forming region in a state being fixed to a predetermined shape, thereby an aluminide intermetallic compound is formed by self-combustion reaction between said metal powder and said aluminum (Al), and a dispersing material is dispersed into said matrix.

25 Claims, 9 Drawing Sheets

COMPOSITE MATERIAL AND METHOD FOR PRODUCTION OF THE SAME

BACKGROUND OF THE INVENTION AND RELATED ART STATEMENT

The present invention relates to a composite material and a method for production of the same.

A composite material is a composition aggregate in which a plurality of materials are macroscopically mixed, and thus complementary employment of mechanical characteristics of each material enables a demonstration of characteristics that was not realized by the material independently. Fundamentally, it is a technique that combines materials and materials together, and has various combinations based on matrixes, reinforcing materials (dispersing materials), purposes of use, and cost.

Among them, a metal matrix composite material, or an intermetallic compound matrix composite material is a composite material in which metals, such as Al, Ti, Ni, and Nb, or intermetallic compounds, such as TiAl, $Ti_3Al$, and $Al_3Ti$, NiAl, $Ni_3Al$, $Ni_2Al_3$, $Al_3Ni$, $Nb_3Al$, $Nb_2Al$, and $Al_3Nb$, are used as a matrix, inorganic materials, such as ceramics, are used as a reinforcing material to be composite material materialized. Accordingly, taking advantage of the characteristics of being lightweight and having a high strength, application of a metal matrix composite material, or an intermetallic compound matrix composite material, for many fields, such as universe and aviation industry field are now promoted.

Besides, in general an intermetallic compound matrix composite material has a fault that fracture toughness is low as compared with a metal matrix composite material, but on the other hand, based on mechanical and physical characteristic of a matrix, it also has characteristic superior in heat-resistant characteristics, abrasion resistant characteristics, and has low thermal expansion and high rigidity.

A method for production of an intermetallic compound matrix composite material includes a method in which an intermetallic compound powder is beforehand produced by a mechanical alloying (MA) method etc., and subsequently it is molded with fiber and/or particles used as a reinforcing material etc. under a high temperature and a high-pressure condition using a hot pressing (HP), or hot isostatic pressing (HIP).

A problem in conventional methods of producing an intermetallic compound matrix composite material is as follows: in order to produce a densified intermetallic compound matrix composite material, a high temperature and a high pressure are required to be applied and an intermetallic compound should be sintered to obtain a densified composite material using powder metallurgical production methods, such as HP method and HIP method. Other problems are that a pretreatment process is required, performance and scale of a producing apparatus are restricted, and a production of the composite material with a large size or complicated shape is extremely difficult, simultaneously near net shape method in consideration of the shape of final products cannot be applied, and thereby, machining processing is required in later processes.

Besides, there is a problem that synthesis of an intermetallic compound powder by MA etc. is beforehand required as a pretreatment process, and many stages are required in the producing process, thereby the process turns to be complicated. Therefore, as mentioned above, since a conventional method for production of an intermetallic compound matrix composite material is a method for production conducted under a high temperature and a high-pressure condition with a necessity of the processes over many stages, it is a method for production requiring very high cost.

There have been generally known, as a method for producing an intermetallic compound matrix composite material, techniques for diffusion-bonding a sheet-like or foil-like metal and a fiber-like or granular ceramics under a high pressure such as HP method, HIP or the like being classified as a solid state fabrication method, and said powder metallurgical production methods wherein metallic powder is used. Any of the above-mentioned solid state fabrication methods and liquid state fabrication methods requires high temperature and high pressure. Additionally, there is known, as a liquid state fabrication method, a method wherein a composite material is forcedly produced by compounding a metal and a ceramic utilizing a mechanical energy such as a high pressure or the like, such as high pressure infiltration method, melt forging method or the like. Furthermore, any of thus produced composite materials has always a simple shape, such as a plate-like or a disk-like one. It also requires plasticity processing, mechanical processing or the like to obtain a finished product. Therefore, those methods are quite expensive ones since the processing cost is quite high due to the co-presence of ceramic phase in the product.

There is proposed, as the related technique for solving such problems, especially a method for providing a composite material at relatively lower cost, a method for producing a metal matrix composite material which does not require a high pressure for production, not likewise the conventional synthetic process. For example, there is proposed a method for producing a metal matrix composite material having metals, such as an aluminum (Al), as a matrix, in which a formed body comprising reinforcing materials having a minute piece shape and minute pieces having a getter effect of oxygen and nitrogen, such as titanium (Ti), is formed, and then immersed into molten metals, such as aluminum (Al), is disclosed as a method utilizing a liquid phase process in which molten metal is infiltrated under a pressureless condition (See Japanese Patent No. 3107563, for example).

However, according to the above described method, it is necessary that a pressure is applied to mixed powder in the method to produce a formed body, and that the formed body is soaked in a molten metal, such as aluminum (Al), and therefore, the formed body should have a certain strength durable for handling during that period. Accordingly, it is required to use a high pressure at the time of forming the formed body. Thus, the shape of the product to be produced is limited. Besides, the composite material obtained is limited to metal matrix composite materials having a matrix formed from metal containing less amount of an intermetallic compound therein. Furthermore, since a formed body expands due to an exothermic reaction between titanium (Ti)—aluminums (Al), immersion of the formed body into a molten metal reduces a volume fraction of a reinforcing material, leading to difficulty in producing a composite material with a higher reinforcing material volume fraction, and in proving a composite material having controlled material characteristics inclusive of a higher mechanical strength.

Moreover, there have been proposed, as another method, a technique wherein a molten aluminum is infiltrated into a ceramic porous body by capillary pressure without giving a pressure after the wettability between a molten metal and a ceramic is improved by forming $Mg_3N_2$ on the surface of the ceramic body by utilizing a gas phase reaction in situ with evaporating Mg in nitrogen atmosphere (See JP-A-1-273659, JP-A-2-240227, or the like). This technique, however, has such problems that the infiltration speed of a molten metal is quite slow since $Mg_3N_2$ is coated in situ on the surface of the ceramic body, and that the adjustment of atmosphere for pressureless infiltration is very time-consuming. Additionally, there is such a problem that the reduction in the production cost of a composite material can not be attained since this technique requires the preparation of a porous ceramic body by firing a formed green ceramic body in advance, or the like.

As a related technique for solving the above described various problems, a method for production of an intermetallic compound matrix composite material is disclosed, in which self-combustion reaction by a metal powder mixed with a predetermined reinforcing material and aluminum (Al) molten metal is proceeded (See JP-A-2002-47519, for example). According to this method for production, as is shown in FIG. 2(*a*), molten aluminum (Al) 4 is infiltrated into pore 3 of a mixed material 2 comprising a dispersing material and a metal powder, which is filled in a reaction container 1 to induce a self-combustion reaction proceeds in-situ (on-the-spot), thereby the near-net shaping in the form of copied finished form of a composite material 5, such as an intermetallic compound matrix composite material having a high melting point, can be achieved under a low temperature and pressureless conditions, by an infiltration process that is completed in a very short time. Therefore, the amount of energy consumed in this method is markedly smaller as compared with conventional methods, thus leading to a method for producing a composite material with reduced producing cost.

However, since free control of the extraordinary large heat of reaction generated is not possible in a material synthesis process similar to the above described method for production utilizing a self-combustion reaction between elements (typically combustion synthesis reaction (SHS reaction)), this method is used in a synthesis of ceramic powder, or a compound having a high melting point (for example, a synthetic process of AlN and $Si_3N_4$ powder in nitrogen gas atmosphere using aluminum (Al) and silicon (Si) as start raw materials (direct nitriding method)), but in produce of a bulk body, it is known to be difficult to give a densified fine structure to the bulk body obtained due to pore formation by exothermic reaction, thus leading to difficulty of synthesis of a composite material having densified fine structure using the method. Therefore, it has been required in industrial world to provide a composite material having more densified fine structure than intermetallic compound matrix composite materials obtained by the above described method for production, and simultaneously having outstanding material characteristics resulting from the structure, and a method for production thereof.

SUMMARY OF THE INVENTION

The present invention is accomplished in view of problems of such conventional technique. An object of the present invention is to provide a composite material having a densified fine structure with a reduced production cost, and a method for producing a composite material with less number of the steps by which any desired final shape, especially large sized and complicated shape, and densified fine structure may be obtained.

Namely, according to the present invention, provided is a composite material producible by filling a mixed material containing a metal powder capable of inducing a self-combustion reaction upon contacting aluminum (Al) and a dispersing material in a reaction container and infiltrating molten aluminum (Al) into pores inside said mixed material, thereby a dispersing material is dispersed in a matrix, wherein the composite material is producible by steps of filling said mixed material in a space forming region to be defined by at least two container elements when said at least two container elements are integrated into one body with said mixed material being filled therein; said container elements being used as a reaction container when integrated into one body, and then infiltrating said aluminum (Al) which is molten due to heat generated by said self-combustion reaction into pores inside said mixed material through at least one hole formed in an upper part of a reaction container formed by combining said at least two container elements in which said mixed material is filled in said space forming region in a state being fixed to a predetermined shape, thereby an aluminide intermetallic compound is formed by the self-combustion reaction between said metal powder and said aluminum (Al), and a dispersing material is dispersed into said matrix.

In the present invention, it is preferred that the proportion of aluminum being contained in a matrix to the whole matrix is 60 mass % or less, and that the metal powder is a powder comprising at least one member of metals selected from the group consisting of titanium (Ti), nickel (Ni), and niobium (Nb).

In the present invention, it is preferable that a hole is formed of the annular member having a stress buffering effect, and that a mixed material is filled in a lower part of the inner portion of holes.

In the present invention, it is preferable that a value (X/Y) of a ratio of an internal diameter (X) of a hole to a maximum infiltrated distance (Y) of melt-infiltrated aluminum (Al) is 0.06 to 0.5, and that a volume fraction of a dispersing material in a whole composite material is 10 to 70% by volume.

In the present invention, it is preferable that a dispersing material is an inorganic material having at least one kind of shape selected from the group consisting of fiber, particle, and whisker, and that the inorganic material is at least one kind selected from the group consisting of $Al_2O_3$, AlN, SiC, and $Si_3N_4$. In the present invention, it is a preferable that a ratio (%) of a mean particle diameter of a metal powder to a mean particle diameter of the dispersing material is 5 to 80%.

Besides, according to the present invention, a method for producing a composite material obtainable by filling a mixed material containing a metal powder that can induce a self-combustion reaction upon contacting aluminum (Al) and a dispersing material in a reaction container and melt-infiltrating aluminum (Al) into pores inside the mixed material to disperse the dispersing material in a matrix, wherein said method comprises steps of filling said mixed material in a space forming region to be defined by at least two container elements when said at least two container elements are integrated into one body with said mixed material being filled therein; said container elements being used as a reaction container when integrated into one body, and then infiltrating said aluminum (Al) which is molten due to heat generated by said self-combustion reaction into pores inside said mixed material through at least one hole formed in an upper part of a reaction container formed by combining said at least two container elements in which said mixed material is filled in said space forming region in a state being fixed to a predetermined shape, thereby an aluminide intermetallic compound is formed by the self-combustion reaction between said metal powder and said aluminum (Al), and a dispersing material is dispersed into said matrix.

In the present invention, it is preferable that a metal powder is a powder comprising at least one member of metals selected from the group consisting of titanium (Ti), nickel (Ni), and niobium (Nb).

In the present invention, when a metal powder is a titanium (Ti) powder, it is preferable that a mass ratio of a melt-infiltrated aluminum (Al) to the titanium (Ti) powder (Al:Ti) is 1:0.17 to 1:0.57; when a metal powder is a nickel (Ni) powder, it is preferable that a mass ratio of a melt-infiltrated aluminum (Al) to the nickel (Ni) powder (Al:Ni) is 1:0.20 to 1:0.72; and further when a metal powder is a niobium (Nb) powder, it is preferable that a mass ratio of a melt-infiltrated aluminum (Al) to the niobium (Nb) powder (Al:Nb) is 1:0.27 to 1:1.13.

In the present invention, it is preferable that a hole or holes are formed of an annular member having a stress buffering effect, and that a mixed material is filled in a lower part of the inner portion of holes.

In the present invention, it is preferable that a value (X/Y) of a ratio of an internal diameter (X) of a hole to a maximum infiltrated distance (Y) of a melt-infiltrated aluminum (Al) is 0.06 through 0.5, and that a dispersing material is an inorganic material having at least one form selected from the group consisting of fiber, particle, and whisker.

In the present invention, it is preferable that an inorganic material is at least one kind selected from the group consisting of $Al_2O_3$, AlN and SiC, and $Si_3N_4$, and that a ratio (%) of a mean particle diameter of a metal powder to a mean particle diameter of a dispersing material is 5 through 80%. In the present invention, it is preferable that a reaction container is a container at least inner wall of which is composed of carbon material.

In the present invention, it is preferable that a reaction container further has a runner channel having a shape of a slope inclining toward a lower part from an upper part of the reaction container in a side part of the reaction container, and at least one second hole communicating with the runner channel, and that aluminum (Al) is melt-infiltrated through a first hole and the at least one second hole independently into pores inside of a mixed material, respectively.

In the present invention, when a metal powder is titanium (Ti) powder and a dispersing material is a particle (ceramic particle) comprising at least one member of ceramics selected from the group consisting of AlN, Si, and $Si_3N_4$, a value (Ti/ceramics) of a ratio of a volume of the titanium (Ti) powder to a volume of the ceramic particle, and a percentage of pores to a volume of a space of a reaction container (porosity (%)) satisfy one of following relationships (1) through (6):

(1) $0.1 \leqq (Ti/ceramics) < 0.14$, $25 \leqq$ porosity (%) $\leqq 60$;

(2) $0.14 \leqq (Ti/ceramics) < 0.27$, $25 \leqq$ porosity (%) $\leqq 70$;

(3) $0.27 \leqq (Ti/ceramics) < 0.53$, $25 \leqq$ porosity (%) $\leqq 75$;

(4) $0.53 \leqq (Ti/ceramics) < 1$, $30 \leqq$ porosity (%) $\leqq 75$;

(5) $1 \leqq (Ti/ceramics) < 1.4$, $45 \leqq$ porosity (%) $\leqq 80$; and (6) $1.4 \leqq (Ti/ceramics) \leqq 2$, $50 \leqq$ porosity (%) $\leqq 80$.

In the present invention, when a metal powder is titanium (Ti) powder and a dispersing material is $Al_2O_3$ particle, it is preferable that a value ($Ti/Al_2O_3$) of a ratio of a volume of titanium (Ti) powder to a volume of $Al_2O_3$ particle, and a percentage (porosity (%)) of pore to a volume of a space of a reaction container satisfy one of following relationships (7) through (12):

(7) $0.1 \leqq (Ti/Al_2O_3) < 0.14$, $25 \leqq$ porosity (%) $\leqq 60$;

(8) $0.14 \leqq (Ti/Al_2O_3) < 0.27$, $25 \leqq$ porosity (%) $\leqq 70$;

(9) $0.27 \leqq (Ti/Al_2O_3) < 0.53$, $25 \leqq$ porosity (%) $\leqq 75$;

(10) $0.53 \leqq (Ti/Al_2O_3) < 1$, $30 \leqq$ porosity (%) $\leqq 75$;

(11) $1 \leqq (Ti/Al_2O_3) < 1.4$, $45 \leqq$ porosity (%) $\leqq 80$; and

(12) $1.4 \leqq (Ti/Al_2O_3) \leqq 2$, $50 \leqq$ porosity (%) $\leqq 80$.

DESCRIPTION OF NOTATIONS

Figure 1A:
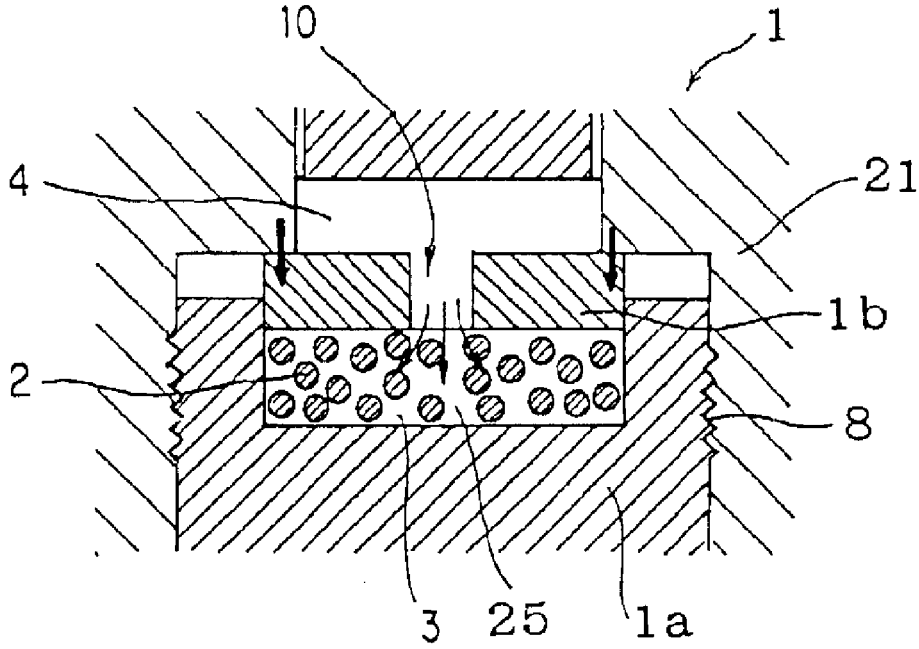
FIGS. 1(*a*) and (*b*) show a pattern diagram illustrating an example of a method for producing a composite material of the present invention, and FIG. 1(*a*) is a schematic showing how to prepare the present composite material and FIG. 1(*b*) is a schematic showing of the present composite material.

1*a*, 1*b* . . . Container element
1 . . . Reaction container
2 . . . Mixed material
3 . . . Pore
4 . . . Aluminum (Al)
5 . . . Composite material
6 . . . Matrix
7 . . . Dispersing material
8 . . . Screw part
10 . . . Hole
15 . . . Annular member
20 . . . Second hole
21 . . . Outer casing
22 . . . Carbon material
23 . . . Runner channel
24 . . . Bolt for fixation
25 . . . Space forming region
30 . . . Mold type container

DETAILED DESCRIPTION OF PREFERRED EMBODIMENTS

Hereinafter, although the present invention will be illustrated in detail based on embodiments, the present invention is not limited to these embodiments.

A first aspect of the present invention is characterized by a composite material producible by filling a mixed material containing a metal powder capable of inducing a self-combustion reaction upon contacting aluminum (Al) and a dispersing material in a reaction container and infiltrating molten aluminum (Al) into pores inside said mixed material, thereby a dispersing material is dispersed in a matrix, wherein the composite material is producible by steps of filling said mixed material in a space forming region to be defined by at least two container elements when said at least two container elements are integrated into one body with said mixed material being filled; said container elements being used as a reaction container, and then infiltrating said aluminum (Al) which is molten due to heat generated by said self-combustion reaction into pores inside said mixed material through at least one hole formed in an upper part of a reaction container formed by combining said at least two container elements in which said mixed material is filled in said space forming region in a state being fixed to a predetermined shape, thereby an aluminide intermetallic compound is formed by the self-combustion reaction between said metal powder and said aluminum (Al), and a dispersing material is dispersed into said matrix. Hereinafter, description will be given in detail.

Figure 1B:
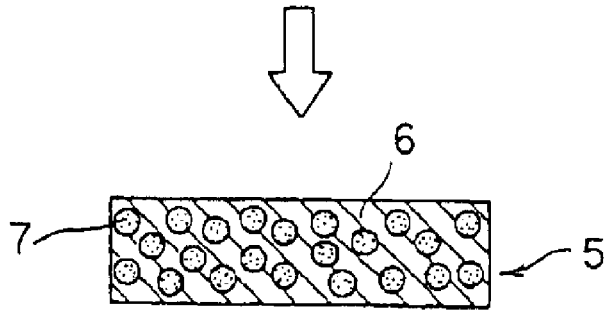

FIG. 1(*a*) is a pattern diagram illustrating an example of a method for producing a composite material of the present invention. FIG. 1(*a*) shows a state that a mixed material 2, in which a dispersing-material and a metal powder are mixed is filled in a space forming region 25 of a container element 1*a* having a suitable size and a suitable shape, a container element 1*b* (lid member) having a hole 10 (routing hole) through which molten aluminum (Al) is infiltrated in is placed on the upper side of the mixed material 2, the mixed material 2 is fixed with a predetermined shape, and the molten aluminum (Al) 4 is infiltrated through a hole 10 to pores 3, that is, the pores 3 formed by neighboring mixed-materials 2. In addition, a reference numeral 1 represents a reaction container and 21 represents an outer casing.

In this embodiment, aluminum (Al) 4 is melt-infiltrated, thereby a metal powder constituting a mixed material 2 (not shown) is contacted to the aluminum (Al) 4 in a molten state to proceed a self-combustion reaction, and thus the aluminum (Al) 4 is displaced by an aluminide intermetallic compound. As a result, a composite material 5 of this embodiment is obtained, as shown in FIG. (*b*) in which a dispersing material 7 is dispersed in matrix 6 including the aluminide intermetallic compound.

Besides, in this embodiment, since formation of an aluminide intermetallic compound is promoted using heat generated by the self-combustion reaction between aluminum (Al) and one of metals in powder, a composite material is produced under a low-temperature condition. That is, a molten aluminum is infiltrated into the mixed material by using generated by the self-combustion reaction as a driving force for the infiltration, and therefore, the composite material can be produced under a relatively lower temperature condition since the internal energy is utilized, as mentioned above. Accordingly, since a high pressure is not required as in conventional methods for production, such as HP method or HIP method, a composite material may be obtained by pressureless infiltration. Thus, a composite material of this embodiment may be appropriately applied to the production of a composite material having a comparatively large and/or complicated shape that have been difficult to be realized in terms of performance of producing apparatus according to the conventional ones.

Figure 2A:
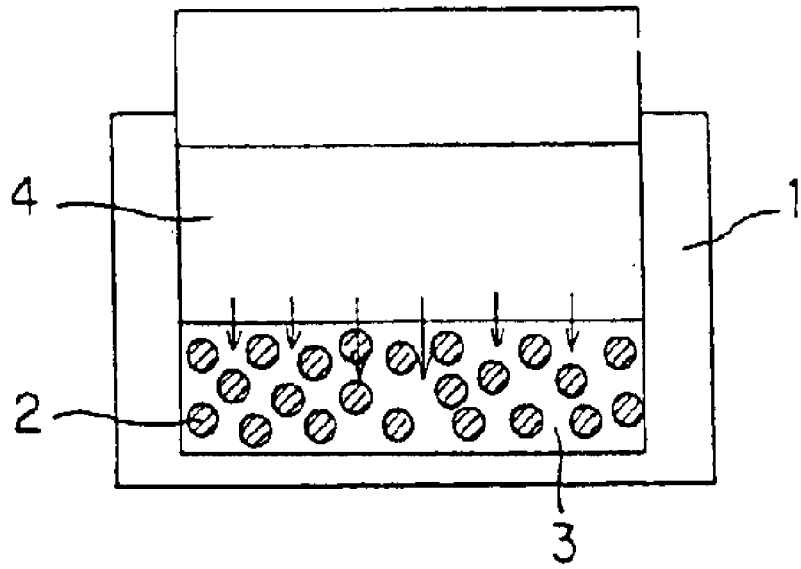
FIGS. 2(*a*) and (*b*) show a pattern diagram illustrating an example of a method for production of a conventional composite material, and FIG. 2(*a*) is a schematic showing how to prepare the conventional composite material and FIG. 2(*b*) is a schematic showing of the conventional composite material.
Figure 2B:
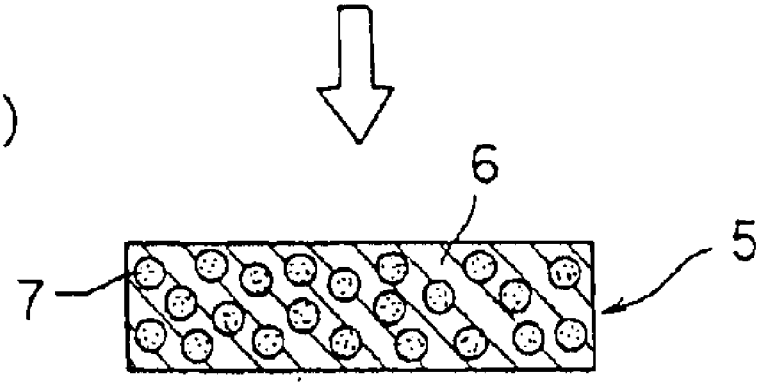

Furthermore, as shown in FIG. 1(*a*), a container element 1*b* having at least one hole 10 is placed on an upper face of a mixed material 2, and aluminum (Al) 4 is infiltrated in through said at least one hole 10. At this time, the mixed material 2 filled in the space formation region of the container element 1*a* is fixed so that it may give a predetermined shape by the container element 1*b*, and thus the predetermined shape of the mixed powder 2 is maintained, even after aluminum (Al) 4 is infiltrated. Furthermore, aluminum (Al) 4 is infiltrated into details of the pores 3, as is shown in FIG. 2(*b*), an open porosity is reduced as compared with a composite material 5 obtained by infiltration of aluminum (Al) 4 without using a container element 1*b* (refer to FIG. 1(*b*)), and thus a composite material having a dense characteristic can be obtained. Besides, after the infiltration of the aluminum (Al) 4, faults, such as curvature, are rarely observed and a composite material having a desired shape may be obtained.

Furthermore, complicated processes for producing a preform provided with strength without causing collapse at the time of infiltration of molten aluminum (Al), such as calcination and press molding, are unnecessary, leading to a composite material produced by simple operations.

In addition, in order to fix a mixed material 2 so that predetermined shape may be formed as shown in FIG. 1(*a*), for example, means of forming a screw part 8 in the container element 1*a* may be mentioned. Thereby fine-tuning may be enabled so that a desired moderate pressure may be applied to the mixed material 2. However, it cannot be overemphasized that means for fixing a mixed material is not limited to the embodiment shown in FIG. 1(*a*).

In the present invention, the proportion of aluminum (Al) being contained in a matrix to the whole matrix is preferably 60 mass % or less, more preferably 2 to 50 mass %. That is, if aluminum (Al) in the form of metal is remained in the matrix formed, a composite material of the embodiment shows excellent fracture toughness, and simultaneously since infiltration path of aluminum (Al) exists as pores in the mixed material, aluminum (Al) is excellently infiltrated. In this respect, if the proportion of aluminum (Al) in the whole matrix exceeds 60 mass %, although the composite material shows a high fracture toughness value, a Young's modulus falls and advantage as a high rigid material declines. Besides, it is not preferable that phenomenon, such as decrease in strength, is easily observed in a melting point region of aluminum (Al). Furthermore, when a ratio of aluminum (Al) is increased, it is not preferable that decrease in infiltration is induced due to lowering of quantity of a metal powder used as infiltration driving force.

Metal powder used in the present invention induces a self-combustion reaction to form an aluminide intermetallic compound by contacting aluminum (Al) in molten state (Aluminum (Al) molten metal). Specifically, a powder comprising at least one kind of metal selected from the group consisting of titanium (Ti), nickel (Ni), and niobium (Nb) is used, and thus these metal powder easily form an aluminide intermetallic compound while having excellent reactivity, which is preferable. Following equations (1) through (3) shows representative examples of reactions caused when these metal powder are used. As is shown in the following equations (1) through (3), these reactions are exothermic reactions (self-combustion reaction), heat of reaction is used to obtain a composite material of the present invention.

[Equation 1]

$$3Al+Ti \rightarrow Al_3Ti:\Delta H_{298}=-146\text{kJ/mol} \quad (1)$$

ΔH: Heat of reaction (Δ<0 represents an exothermic reaction)

[Equation 2]

$$3Al+Ni \rightarrow Al_3Ni:\Delta H_{298}=-150\text{ kJ/mol} \quad (2)$$

ΔH: Heat of reaction (Δ<0 represents an exothermic reaction)

[Equation 3]

$$3Al+Nb \rightarrow Al_3Nb:\Delta H_{298}=-160\text{ kJ/mol} \quad (3)$$

ΔH: Heat of reaction (Δ<0 represents an exothermic reaction)

Figure 3:
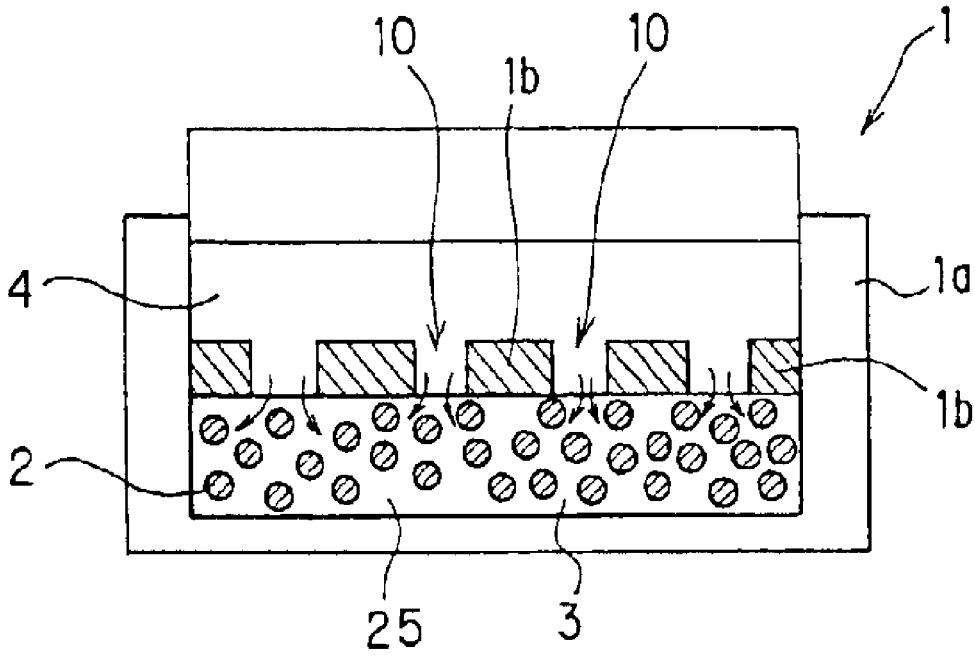
FIG. 3 is a pattern diagram illustrating another example of a method for producing a composite material of the present invention.

FIG. 3 is a pattern diagram illustrating another example of a method for producing a composite material of the present invention. In the embodiment, it is preferable that a plurality of holes 10 are formed in a reaction container 1 (container element 1*b*), which is suitable when a large amount of mixed materials are used (i.e., when a composite material is more large-sized). That is, supply of aluminum (Al) is efficiently carried out through a plurality of holes and a densified fine structure may be provided even in the case where a target structure is large.

Figure 4:
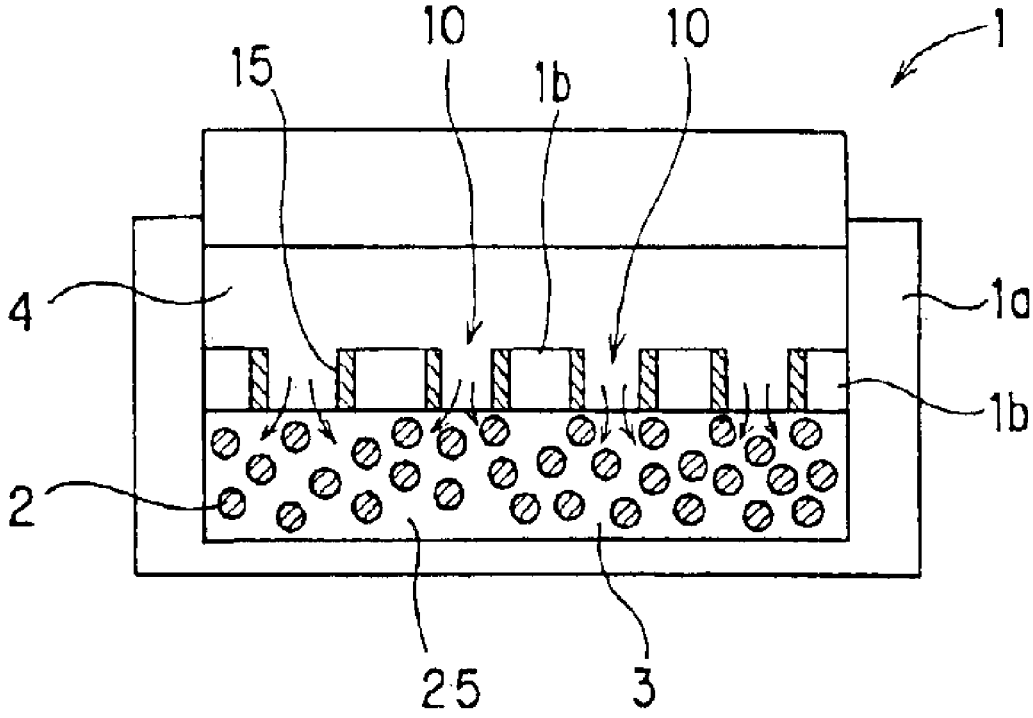
FIG. 4 is a pattern diagram illustrating a still another example of a method for producing a composite material of the present invention.
Figure 5:
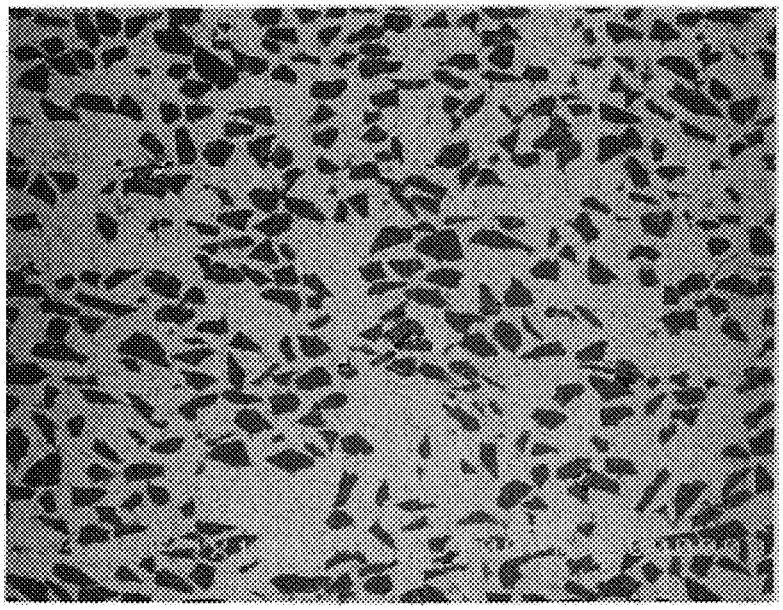
FIG. 5 is a scanning electron microscope photograph (magnification×100) in which a microstructure of a composite material of Example 30 is shown.
Figure 6:
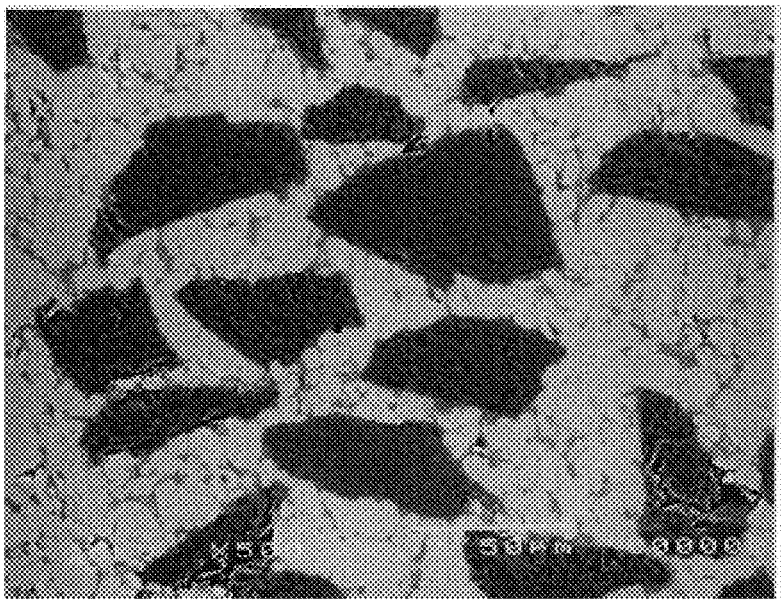
FIG. 6 is a scanning electron microscope photograph (magnification×500) in which a microstructure of a composite material of Example 30 is shown.
Figure 7:
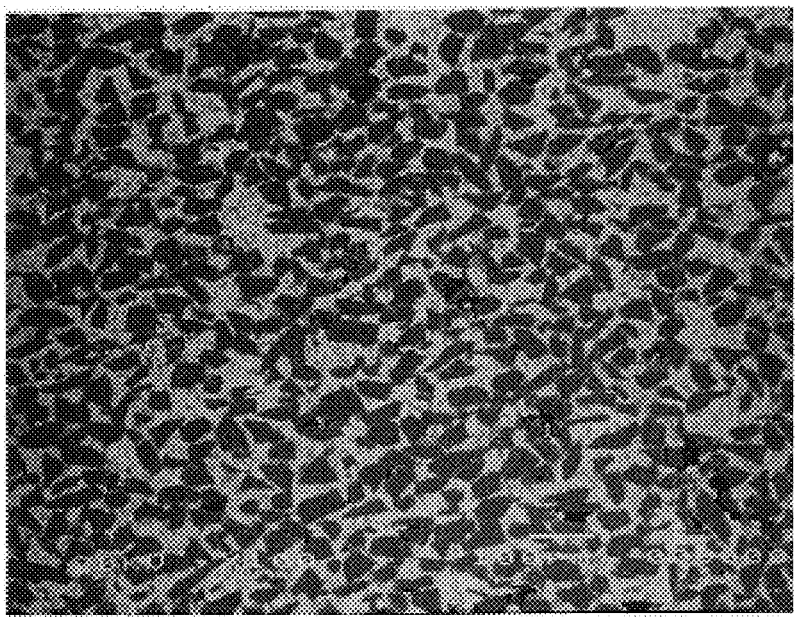
FIG. 7 is a scanning electron microscope photograph (magnification×100) in which a microstructure of a composite material of Example 34 is shown.
Figure 8:
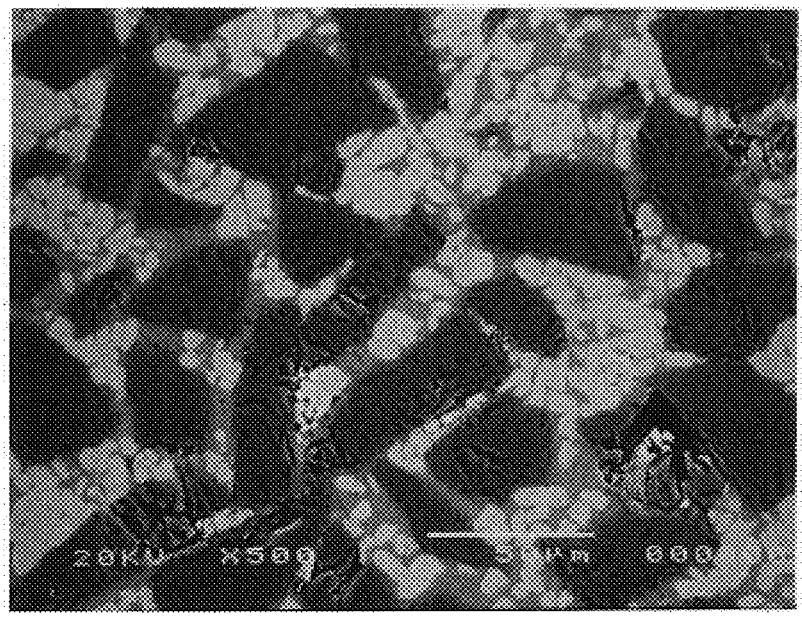
FIG. 8 is a scanning electron microscope photograph (magnification×500) in which a microstructure of a composite material of Example 34 is shown.

Besides, when a composite material is more large-sized, as shown in FIG. 4, it is preferable that the holes 10 are formed of annular member 15 having a stress buffering effect. A "stress buffering effect" here means an effect that buffers stress generated by thermal shrinkage during lowering of the temperature after infiltration of molten aluminum (Al). That is, a case may be assumed that resistance to shrinking demonstrated by aluminum (Al) remained near the holes 10 causes some faults of the composite material obtained, such as deformation and fracturing, but if the holes 10 are formed of annular member 15 having a stress buffering effect, formation of the above described faults may be avoided. In addition, as illustrative examples of materials constituting such annular members 15 having a stress buffering effect, porous carbon, ceramic fiber used as heat insulating material, etc. may be mentioned. Besides, it is also possible to relax stress at the time of shrinkage by giving a corner forming and a roundness forming to a bottom of the holes, i.e., a section where a hole touches a composite material.

In the present invention, it is preferable that the mixed material is additionally filled in the lower part of the inner portion of the hole that contacts the formed body. In a section directly under a hole, the composition of the composite material obtained sometimes includes excessive aluminum (Al) to give resulting inhomogeneous microstructure since this portion becomes the supply portion of molten aluminum. Therefore, since only a part inside a hole may be easily removed after infiltration of molten aluminum (Al) in a composite material of the present invention in which a mixed material is filled in the lower part of the inner portion of a hole. As a result, the yield of the composite material is improved and the production cost is reduced. This is because there is no necessity of removing, by processing, the portion of the formed body placed on just under the hole, i.e., a portion becoming a composite material due to the infiltration. In addition, the term "lower part of the inner portion of a hole" means that the area located to the position up to from the one fourth to one third in term of the height of the hole from the bottom.

In the present invention, a value (X/Y) of a ratio of an inside diameter (X) of a hole to a maximum infiltrated distance (Y) of melt-infiltrated aluminum (Al) is preferably 0.06 through 0.5, more preferably 0.08 through 0.4, and still more preferably 0.1 through 0.35. When X/Y is less than 0.06, an excessively small hole cannot supply sufficient amount of aluminum (Al), leading to unpreferable difficulty in infiltration. On the other hand, similarly, when X/Y exceeds 0.5, it is not preferable that improved effect in infiltration ability of aluminum (Al) becomes difficult to be demonstrated.

In addition, "maximum infiltrated distance" of an aluminum (Al) used in the present invention means a distance from an end of a hole 10 to an endmost part of a mixed material 2 filled in a reaction container 1 shown in FIG. 1. Besides, in the present invention, a shape of a hole may not be especially limited, but may be of any shape, such as circular shape, ellipse shape, polygon shape, or indeterminate shape. In addition, when a shape of the hole is circular shape, an inside diameter of a hole means an inside diameter; when it is an ellipse shape, an average of a major axis and a minor axis; and when it is polygon or indeterminate shape, an average of a maximum opening diameter and a minimum opening diameter.

In the present invention, a ratio of a dispersing material occupied in a whole composite material (a volume fraction) is preferably 10 through 70% by volume, and more preferably 30 through 60% by volume. When a volume fraction of a dispersing material is less than 10% by volume, strength sufficient as a composite material may not be demonstrated, and when it exceeds 70% by volume, a case is assumed in which fault is caused in infiltration of aluminum (Al) molten metal, and thereby formation of an aluminide intermetallic compound becomes difficult, leading to unpreferable formation of inhomogeneous microstructure. In addition, in aluminum (Al) that is melt-infiltrated in the present invention, it cannot be overemphasized that the effect described so far may be demonstrated when using not only pure aluminum (Al) but various aluminum (Al) alloys.

In the present invention, it is preferable that a dispersing material is inorganic material having at least one kind of shape selected from the group consisting of fiber, particle, and whisker, and because an inorganic material having such shape is used, a composite material of the present invention has physical characteristics etc. in line with use as a final product.

Besides, in the present invention, it is preferable that the above described inorganic material is at least one kind selected from the group consisting of $Al_2O_3$, AlN, SiC, and $Si_3N_4$. A composite material shows various characteristics based on a combination of an intermetallic compound included in a matrix constituting the composite material, and a dispersing material, and therefore a combination giving a composite material demonstrating characteristics according to application is suitably selected. Table 1 shows kinds of dispersing materials consisting of various kinds of inorganic materials, and an example of characteristics of the composite materials obtained when they are used together with intermetallic compounds.

TABLE 1

| Dispersing material | Characteristic of composite produced using a dispersing material showing in a left column |
|---|---|
| $Al_2O_3$ | Oxidation resistance, high strength, abrasion resistance, low coefficient of thermal expansion |
| AlN | High thermal conductivity, high strength, wear-resistance, low coefficient of thermal expansion |
| SiC | High thermal conductivity, electric conductivity, high strength, abrasion resistance, low coefficient of thermal expansion |
| $Si_3N_4$ | High strength, abrasion resistance, low coefficient of thermal expansion |

In the present invention, a ratio (%) of a mean particle diameter of a metal powder to a mean particle diameter of a dispersing material is preferably 5 through 80%, and more preferably 10 through 60%. When a mean particle diameter of a metal powder is less than 5% of a mean particle diameter of a dispersing material, the metal powder itself is hard to come to hand, and danger of a dust explosion accompanies, leading to inconvenience in handling. And when it exceeds 80%, activity of a self-combustion reaction is not fully increased, leading to difficulty in obtaining densified composite material, which is not preferable. Specifically, when a mean particle diameter of a dispersing material is 50 $\mu$m, a mean particle diameter of a metal powder is preferably 2 through 40 $\mu$m, and more preferably 5 through 30 $\mu$m.

Next, a second aspect of the present invention will be described. A second aspect of the present invention is characterized by a method for producing a composite material in which a mixed material including a metal powder capable of causing a self-combustion reaction by contacting aluminum (Al) and a dispersing material is filled in a reaction container, and simultaneously the aluminum (Al) is melt-infiltrated into pores inside of the mixed material to disperse the dispersing material in matrix, wherein a reaction container composed of at least two container elements is used as a reaction container and said at least two container elements are so constituted that a space to be filled with the mixed material is formed when said at least two container elements are integrated into one body, the mixed material is filled in a region (space forming region) forming at least one space in the container elements when at least two container elements is integrated into one body by combining them with containing the mixed material filled in the space forming region in a state fixed with a predetermined shape, aluminum (Al) is melt-infiltrated into the pores inside the mixed material through at least one first hole formed in an upper part of the reaction container, and an aluminide intermetallic compound is formed due to the self-combustion reaction between the metal powder and the aluminum (Al), and the dispersing material is dispersed into the matrix. Hereinafter, description will be given in detail.

In a method for producing a composite material of the present invention, as is shown in FIG. 1, a mixed material 2 in which a dispersing-material and a metal powder is mixed is filled in a space forming region 25 of a container element 1*a* having a suitable size and a suitable shape, a container element 1*b* (lid member) having a first at least one hole 10 (routing hole) through which molten aluminum (Al) is infiltrated in is placed on the upper side of the mixed material 2, the mixed material 2 is fixed with a predetermined shape, and the aluminum (Al) 4 is melt-infiltrated through a hole 10 to pores 3, that is, the pores 3 formed by neighboring mixed materials 2 each other. In this embodiment, aluminum (Al) 4 is melt-infiltrated, thereby a metal powder constituting the mixed material 2 (not shown) is contacted to the aluminum (Al) 4 in a molten state to proceed a self-combustion reaction, and thus the aluminum (Al) 4 is displaced by an aluminide intermetallic compound. As a result, a composite material 5 is obtained in which a dispersing material 7 is dispersed in matrix 6 including the aluminide intermetallic compound.

Besides, in this embodiment, since formation of an aluminide intermetallic compound is promoted using heat generated by the self-combustion reaction between aluminum (Al) and any one among various appropriate metal powders, a composite material may be produced under a low temperature condition. Furthermore, since a high pressure is not required as in conventional methods for production, such as HP method or HIP method, a composite material is obtained by pressureless infiltration. Thus, a composite material having comparatively large or complicated shapes that have been difficult to be realized because of performance of producing apparatus may be produced.

Furthermore, as shown in FIG. 1(*a*), in this embodiment, a container element 1*b* having at least one hole 10 is placed on the upper face of a mixed material 2, and aluminum (Al) 4 is infiltrated in through said at least one hole 10. At this time, the mixed material 2 filled in the space forming region 25 of the container element 1*a* is fixed so that it may give a predetermined shape by the container element 1*b*, and thus the predetermined shape of the mixed powder 2 is maintained, even after aluminum (Al) 4 is infiltrated. Furthermore, aluminum (Al) 4 may be infiltrated into minute portions of the pores 3, as is shown in FIG. 2(*b*), an open porosity may be reduced as compared with a composite material 5 obtained by infiltration of aluminum (Al) 4 even without using a container element 1*b* (refer to FIG. 1(*b*)), and thus a more densified composite material having a higher density may be produced. Besides, after the infiltration of aluminum (Al), faults such as deformation are rarely observed and a composite material having a desired shape may be obtained.

In addition, in order to fix a mixed material 2 so that predetermined shape may be formed, as shown in FIG. 1, for example, means of forming a screw part 8 in the container element 1*a* may be mentioned. Thereby fine-tuning may be enabled so that a desired moderate pressure may be applied to the mixed material 2. However, it cannot be overemphasized that means for pressurizing a mixed material is not limited to the aspect shown in FIG. 1.

Metal powder used in the present invention causes a self-combustion reaction to form an aluminide intermetallic compound by contacting aluminum (Al) in molten state (aluminum (Al) molten metal). Specifically, a powder comprising at least one kind of metal selected from the group consisting of titanium (Ti), nickel (Ni), and niobium (Nb) is used. These metal powders are preferable since they have good reactivity to easily form a stable aluminide intermetallic compound and readily available and handled. Following equations (4) through (6) show representative examples of reactions caused when these metal powder are used. As is shown in the following equations (4) through (6), these reactions are exothermic reactions (self-combustion reaction), the heat of reaction is used to obtain a composite material of the present invention.

[Equation 4]

$$3Al+Ti \rightarrow Al_3Ti:\Delta H_{298}=-146\ kJ/mol \quad (4)$$

ΔH: Heat of reaction (Δ<0 represents an exothermic reaction)

[Equation 5]

$$3Al+Ni \rightarrow Al_3Ni:\Delta_{298}=-150\ kJ/mol \quad (5)$$

ΔH: Heat of reaction (Δ<0 represents an exothermic reaction)

[Equation 6]

$$3Al+Nb \rightarrow Al3Nb:\Delta_{298}=-160\ kJ/mol \quad (6)$$

ΔH: Heat of reaction (Δ<0 represents an exothermic reaction)

Besides, both of a dispersing material and a matrix are synthesized in-situ in other in-situ methods for production of composite materials disclosed in Japanese Patent No. 2609376 and in JP-A-9-227969, whereas in the present invention, only a matrix is synthesized in-situ. Therefore, kinds of dispersing material may be freely selected and a composite material having desired physical characteristics may be produced. Furthermore, arbitrary selection and setup of kinds and volume fractions of dispersing materials enable control of heat of reaction.

In the present invention, when a metal powder is titanium (Ti) powder, it is preferable that the mass ratio of the melt-infiltrated aluminum (Al) to the titanium (Ti) powder (Al:Ti) is 1:0.17 to 1:0.57. Thereby, a ratio of said aluminum (Al) being contained in said matrix to whole of said matrix may be 60 mass % or less, and thus a composite material having densified fine structure while having a high fracture toughness may be obtained.

Besides, when a metal powder is nickel (Ni) powder, it is preferable that a mass ratio of the melt-infiltrated aluminum (Al) to the nickel (Ni) powder (Al:Ni) is 1:0.20 to 1:0.72. Thereby, a ratio of said aluminum (Al) being contained in said matrix to whole of said matrix may be 60 mass % or less, and thus a composite material having densified fine structure while having a high fracture toughness may be obtained.

Furthermore, when a metal powder is niobium (Nb) powder, it is preferable that a mass ratio of the melt-infiltrated aluminum (Al) to the nickel (Ni) powder (Al:Ni) is 1:0.27 to 1:1.13. Thereby a ratio of said aluminum (Al) being contained in said matrix to whole of said matrix may be 60 mass % or less, and thus a composite material having densified fine structure while having a high fracture toughness may be obtained.

In the present invention, it is preferable that a plurality of holes are formed in a reaction container, and thus use of a large amount of mixed materials is enabled as compared with a case where the number of hole is one. That is, excellent infiltration ability of aluminum (Al) molten metal enables produce of a composite material having densified fine structure even if it is large-sized.

In the present invention, it is preferable that a hole is formed of an annular member having a stress buffering effect, especially when a composite material having a larger size is produced. A "stress buffering effect" used here is as is illustrated in description already given. That is, the resistance to shrinkage of a composite material derived from aluminum (Al) remained near the hole would cause some faults of the composite material obtained, such as fracturing and the like. This is because the stress is concentrated to the combining portion of the hole and a composite material, i. e., the bonding portion thereof. However, if the holes are formed of annular member having a stress buffering effect, the occurrence of the above described faults may be avoided. In addition, as an illustrative example of materials constituting such an annular member having a stress buffering effect, porous carbon, ceramic fiber used as heat insulating material, etc. may be mentioned.

Besides, in the present invention, it is preferable that a mixed material is filled in the lower part of the inner portion of a hole. In a section directly under a hole, the composition of the composite material obtained sometimes includes excessive aluminum (Al) to give resulting inhomogeneous microstructure. Therefore, since only a part inside a hole may be easily removed after infiltration of molten aluminum (Al) in a composite material of the present invention in which a mixed material is filled inside of a hole, generally homogeneous composition may be obtained.

In the present invention, a value (X/Y) of a ratio of an inside diameter (X) of a hole to a maximum infiltrated distance (Y) of melt-infiltrated aluminum (Al) is preferably 0.06 through 0.5, more preferably 0.08 through 0.4, and still more preferably 0.1 through 0.35. When X/Y is less than 0.06, an excessively small hole cannot supply sufficient amount of aluminum (Al), leading to difficulty in infiltration, which is not preferable. On the other hand, similarly, when X/Y exceeds 0.5, an improved effect in the infiltration ability of aluminum (Al) becomes difficult to be demonstrated, which is not preferable.

Next, a detailed description of the present invention will be given with reference to an example of a method for production. There are prepared a dispersing material having a predetermined shape, a metal powder having a predetermined mean particle diameter, such as titanium (Ti), nickel (Ni), and niobium (Nb), and aluminum (Al) as metal that is infiltrated in pore of a mixed material in a reaction container. At this time, a ratio (%) of a mean particle diameter of a metal powder to a mean particle diameter of a dispersing material is preferably 5 to 80%, and more preferably 10 to 60%. When a mean particle diameter of a metal powder is less than 5% of a mean particle diameter of a dispersing material, the metal powder itself is hard to come to hand, and danger of a dust explosion accompanies, leading to inconvenience in handling. And when it exceeds 80%, activity of a self-combustion reaction is not fully increased, leading to difficulty in obtaining densified composite material. Specifically, when a mean particle diameter of a dispersing material is 50 μm, a mean particle diameter of a metal powder to be used is preferably 2 through 40 μm, and more preferably 5 through 30 μm.

In the present invention, it is preferable that a dispersing material is inorganic material having at least one kind of shape selected from the group consisting of fiber, particle, and whisker. If an inorganic material having such shape is used, a composite material having strength and physical characteristics in line with use as a final product may be obtained.

In addition, in the present invention, "a dispersing material having 10 to 150 μm of mean particle diameter" means "a particle having 10 to 150 μm of mean particle diameters" when a shape of the dispersing material is particle-like; and besides, when a shape of the dispersing material is not of particle but of fiber of whisker etc., it means "fiber or whisker, etc. having 0.1 through 30 μm of diameter in the case where a ratio of length/diameter is less than 150," or "fiber or whisker, etc. having 0.5 through 500 μm of diameter in the case where a ratio of length/diameter is 150 or more."

Besides, in the present invention, it is preferable that the above described inorganic material is at least one kind selected from the group consisting of $Al_2O_3$, AlN, SiC, and $Si_3N_4$. A composite material shows various characteristics based on a combination of an intermetallic compound included in a matrix constituting the composite material and a dispersing material, and therefore a combination giving a composite material demonstrating characteristics according to usage may be suitably selected.

In addition, in order to control a mass ratio of the aluminum (Al) included in the matrix and an aluminide intermetallic compound in the composite material obtained, a ratio (volume fraction) of "(metal powder):(dispersing material)" of a mixed material filled in a reaction container is varied, furthermore, a porosity of the mixed material is obtained by measuring a thickness of the mixed material after filling, and aluminum (Al) is assumed to be completely infiltrated into the pore to calculate a required quantity of aluminum (Al). Thereby, a particle volume fraction of the dispersing material and a composition (mass ratio) of the matrix may be calculated from a volume fraction of "the metal powder:the dispersing material" and the porosity of the mixed material.

Besides, a composition of a target matrix before infiltration of aluminum (Al) does not completely agree with an actual matrix composition after the infiltration, and sometimes gives some variation. Next, a description for calculation method of an actual matrix composition after infiltration will be given. A mass ratio of aluminum included in a matrix (Al): an aluminide intermetallic compound may be calculated as follows: a calibration curve is in advance prepared using a mixed powder of an aluminum (Al) and an aluminide intermetallic compound controlled to a predetermined mass ratio using an XRD analysis described in JP-A-2002-47519, and based on the calibration curve, the XRD analysis of the sample in which matrix composition was varied is conducted to calculate the mass ratio based on X-ray strength of an obtained measurement result.

A mixed material obtained by mixing a dispersing material and a metal powder is filled in a space forming region of a container element constituting a reaction container, and the resultant mixed material may be subjected to molding, under a suitable pressure, to form a formed body having a predetermined shape and a predetermined porosity. In addition, a mixed material may be filled into the reaction container after molding of the mixed material conducted by giving a suitable pressure beforehand. Besides, porosity is arbitrarily controllable by changing the pressure to mold. Subsequently, said formed body is fixed by the container element formed by integrating the container elements having one hole or more. Said aluminum (Al) is placed through the container element having one hole or more. At this time, the mixed material may be filled in the lower part of the inner portion of a hole as described above. In addition, the aluminum (Al) placed may not be limited to pure aluminum (Al), but if it is about 90% of purity or more, it may be used without any disadvantage, and moreover various aluminum (Al) alloys may be used. Then, the aluminum (Al) is heated to a temperature higher in terms of ° C. than the temperature at which aluminum (Al) melts (about 660° C.), practically about 700° C. under moderate reduced pressure conditions, for example, under vacuum conditions, and the aluminum (Al) in molten state is infiltrated to the pores of the mixed material through the holes. While the aluminum (Al) in contact with the metal powder precedes a self-combustion reaction, capillary infiltration is induced to form a desired matrix of the composite material in an instant.

Since formation of the matrix itself is completed in a very short time, period for heating taken is enough in about several minutes. Furthermore, after completion of self-combustion reaction, in order to attain homogenization and stabilization of the matrix of a composite material obtained, isothermal hold to a same temperature and hold of heating may be suitably given. Although holding temperature at this time is influenced a little by the material system, it is preferably about 400 through 500° C. higher temperature from a same temperature given by the self-combustion reaction, and a holding time should just be given for several hours from about one hour, if needed.

Figure 11:
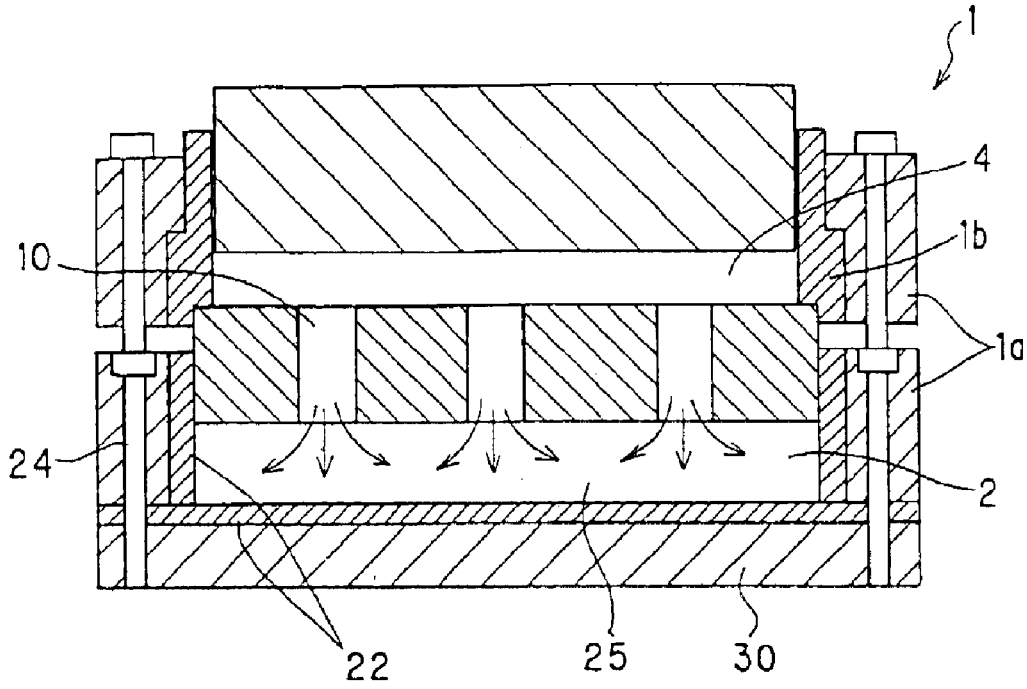
FIG. 11 is a pattern diagram illustrating still another example of a method for producing a composite material of the present invention.

Besides, in the present invention, as shown in FIG. 11, it is preferable that the reaction container 1 has at least an inner wall composed of carbon material 22. When a reaction container 1 which inner wall is constituted in this way is used, after infiltration and cooling of the molten aluminum (Al) the obtained composite material may easily be taken out of the reaction container 1. That is, since the composite material has excellent mold-release characteristic from the reaction container 1, durability of the reaction container 1 also improves and producing cost of the composite material may be reduced.

In addition, in FIG. 11, although a state where only the inner wall of the reaction container 1 is composed of carbon material 22 is shown, it is preferable that a whole reaction container 1 may be composed of carbon material, and that at least a part in contact with the aluminum (Al) and the composite material produced may be composed of carbon material. Furthermore, it is preferred to from a coating by a BN spray, or the like, or lay carbon sheet on the portion on which molten aluminum contacts to improve the releasibility of the resultant composite material. In addition, a reference numeral 24 represents bolts for fixation.

Figure 13:
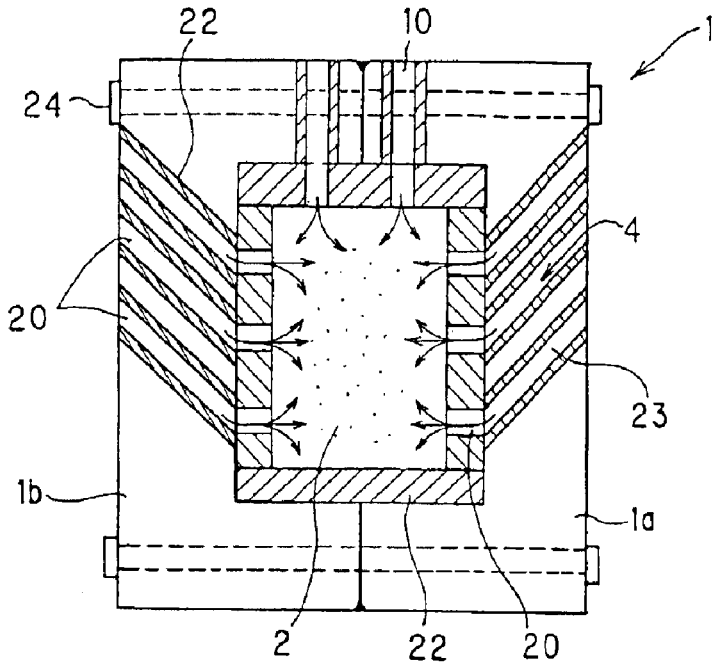
FIG. 13 is a pattern diagram illustrating still another example of a method for producing a composite material of the present invention.

In the present invention, as is shown in FIG. 13, it is preferable that the reaction container 1 has, in side part thereof, runner channels 23 with a shape of a slope inclining toward a lower part from an upper part of the reaction container 1, and further at least one second hole 20 communicating with this runner channels 23, and that aluminum (Al) 4 is melt-infiltrated into the pores inside the mixed material 2 independently through upper holes 10 and the second holes 20 in the side part, respectively. That is, a reaction container 1 having the second routing holes 20 suitably added formed thereto is provided, and aluminum (Al) 4 is melt-infiltrated from each of holes 10 and the second holes 20, and thereby a composite material having densified fine structure as a whole may be produced in the case of a thick structure (structure long in a vertical direction in FIG. 13).

Besides, in the present invention, when a metal powder is a titanium (Ti) powder and a dispersing material is a particle (ceramic particle) comprising at least a kind of ceramics selected from the group consisting of AlN, Si, and $Si_3N_4$, a value of a ratio of a volume of the titanium (Ti) powder to a volume of the ceramic particle (Ti/ceramics (hereinafter only described as "a value (Ti/ceramics)")) and a percentage of pores to a volume of the container (porosity (%)) preferably satisfy one of following relationships (1) through (6) shown below:

(1) 0.1≦(Ti/ceramics)<0.14, 25≦porosity (%)≦60;
(2) 0.14≦(Ti/ceramics)<0.27, 25≦porosity (%)≦70;
(3) 0.27≦(Ti/ceramics)<0.53, 25≦porosity (%)≦75;
(4) 0.53≦(Ti/ceramics)<1, 30≦porosity (%)≦75;
(5) 1≦(Ti/ceramics)<1.4, 45≦porosity (%)≦80; and
(6) 1.4≦(Ti/ceramics)≦2, 50≦porosity (%)≦80.

Namely, if the value (Ti/ceramics) of a mixed material and the porosity are combined so that one of the above described relationships may be satisfied, very excellent infiltration ability of molten aluminum (Al) to the pore of this mixed material may be provided, and thereby more densified composite material having a reduced open porosity may be produced even not under a highly pressurized condition as in HP method or HIP method. In addition, in the light of further increasing the infiltration ability of aluminum (Al) and of producing a more densified composite material having a reduced open porosity, it is still more preferable that a value (Ti/ceramics) and a porosity (%) satisfy either one of following relationships (7) through (14) shown below:

(7) 0.1≦(Ti/ceramics)<0.14, 30≦porosity (%)≦45;
(8) 0.14≦(Ti/ceramics)<0.18, 25≦porosity (%)≦55;
(9) 0.18≦(Ti/ceramics)<0.27, 25≦porosity (%)≦60;
(10) 0.27≦(Ti/ceramics)<0.4, 35≦porosity (%)≦65;
(11) 0.4≦(Ti/ceramics)<0.53, 35≦porosity (%)≦70;
(12) 0.53≦(Ti/ceramics)<0.77, 40≦porosity (%)≦70;
(13) 0.77≦(Ti/ceramics)<1, 45≦porosity (%)≦75; and
(14) 1≦(Ti/ceramics)<2, 50≦porosity (%)≦80.

Besides, in the present invention when a metal powder is a titanium (Ti) powder and a dispersing material is $Al_2O_3$ particle, a value of a ratio of a volume of the titanium (Ti) powder to a volume of $Al_2O_3$ particle (Ti/$Al_2O_3$ (hereinafter, described as only "a value (Ti/$Al_2O_3$)")) and a percentage of pores to a volume in a mold container (porosity (%)) preferably satisfy one of following relationships (15) through (20) shown below:

(15) 0.1≦(Ti/$Al_2O_3$)<0.14, 25≦porosity (%)≦60;
(16) 0.14≦(Ti/$Al_2O_3$)<0.27, 25≦porosity (%)≦70;
(17) 0.27≦(Ti/$Al_2O_3$)<0.53, 25≦porosity (%)≦75;
(18) 0.53≦(Ti/$Al_2O_3$)<1, 30≦porosity (%)≦75;
(19) 1≦(Ti/$Al_2O_3$)<1.4, 45≦porosity (%)≦80; and
(20) 1.4≦(Ti/$Al_2O_3$)≦2, 50≦porosity (%)≦80.

Namely, if the value (Ti/$Al_2O_3$) of a mixed material and the porosity are combined so that one of the above described relationships may be satisfied, very excellent infiltration ability of molten aluminum (Al) to the pores of this mixed material may be provided, and thereby more densified composite material having a reduced open porosity may be produced even not under a highly pressurized condition as in HP method or HIP method. In addition, in the light of further increasing the infiltration ability of aluminum (Al) and of producing a more densified composite material having a reduced open porosity, it is still more preferable that a value (Ti/$Al_2O_3$) and a porosity (%) satisfy either one of following relationships (21) through (29) shown below, and it is especially preferable that they satisfy either one of following relationships (30) through (37) shown below:

(21) 0.1≦(Ti/$Al_2O_3$)<0.14, 30≦porosity (%)≦45;
(22) 0.14≦(Ti/$Al_2O_3$)<0.18, 30≦porosity (%)≦55;
(23) 0.18≦(Ti/$Al_2O_3$)<0.27, 30≦porosity (%)≦60;
(24) 0.27≦(Ti/$Al_2O_3$)<0.4, 35 ≦porosity (%)≦65;
(25) 0.4≦(Ti/$Al_2O_3$)<0.53, 35≦porosity (%)≦70;
(26) 0.53≦(Ti/$Al_2O_3$)<0.77, 40≦porosity (%)≦70;
(27) 0.77≦(Ti/$Al_2O_3$)<1, 45≦porosity (%)≦75;
(28) 1≦(Ti/$Al_2O_3$)<1.4, 50≦porosity (%)≦75; and
(29) 1.4≦(Ti/$Al_2O_3$)≦2, 55≦porosity (%)≦80;
(30) 0.14≦(Ti/$Al_2O_3$)<0.18, 35≦porosity (%)≦45;
(31) 0.18≦(Ti/$Al_2O_3$)<0.27, 35≦porosity (%)≦55;
(32) 0.27≦(Ti/$Al_2O_3$)<0.4, 40≦porosity (%)≦60;
(33) 0.4≦(Ti/$Al_2O_3$)<0.53, 40≦porosity (%)≦65;
(34) 0.53≦(Ti/$Al_2O_3$)<0.77, 45≦porosity (%)≦65;
(35) 0.77≦(Ti/$Al_2O_3$)<1, 50≦porosity (%)≦70;
(36) 1≦(Ti/$Al_2O_3$)<1.4, 55≦porosity (%)≦75; and
(37) 1.4≦(Ti/$Al_2O_3$)<2, 60≦porosity (%)≦75.

According to the above described method for producing a composite material of the present invention, special feature is efficiently employed to produce a large-sized composite material of complicated shape having densified fine structure and outstanding material characteristics resulting from the densified fine structure concerned extremely easily. Besides, since near net shaping in which a shape of a final product is considered may be conducted, subsequent machining processing are not required. Furthermore, since preparation of an aluminide intermetallic compound as a pretreatment process is not required, reduction of producing cost may be easily attained.

EXAMPLE

Hereinafter, illustrative operation results of the present invention will be described.

(Measuring Method of Various Physical Property Values, Various Evaluation Methods)

[Open Porosity]

A sample of a predetermined shape was cut from a measuring object, and measurement was conducted by Archimedes method.

[Four-point Bending Strength]

A sample of a predetermined shape was cut from a measuring object, a four-point bending test was carried out according to JIS R1601, and measurement was carried out.

[Young's Modulus]

A sample of a predetermined shape was cut from an obtained composite material, four-point bending test was carried out according to JIS R1601, and Young's modulus was measured.

[Fracture Toughness Value]

From the obtained composite material, a sample having a predetermined shape with a cut (notch) given therein was made, it was measured by four-point bending test, and fracture toughness value was calculated according to the chevron notch method.

[Infiltration Ratio]

Calculated according to following equation (7).

[Equation 7]

$$\text{Infiltration ratio (\%)} = 100 \times (\text{infiltrated distance})/(\text{maximum infiltrated distance}) \quad (7)$$

(Where, a "infiltrated distance" represents a distance (inside diameter of a hole excluded) which aluminum (Al) actually infiltrated, and a distance from which a portion abound in pores that are observed in a non-infiltrated region is excluded. A "maximum infiltrated distance" represents a distance from an end of a hole to an endmost part of the mixed material filled into the reaction container.)

[Porosity]

Before infiltration, a sample thickness after preparation and molding was measured, and porosity was calculated according to following equation (8). Besides, after infiltration, a sample thickness after preparation and infiltration was measured, and porosity was calculated according to following equation (8).

[Equation 8]

$$\text{Porosity } \varepsilon(\%) = \frac{V_{pore}}{V_D + V_{Metal\ powder} + V_{pore}} \quad (8)$$

(Where, $V_{pore}$ represents a volume of pores, $V_D$ a volume of a dispersing material, and $V_{Metal\ powder}$ a volume of the metal powder.)

[Evaluation on Infiltration Ability]

Evaluation was given for each case as follows;

an infiltration ratio is 100%: "◎",

85% or more: "○",

60% or more: "Δ", below 60%: "x".

[Evaluation of Dense Characteristic]

Evaluation was given for each case as follows:

an open porosity being 0.1 or less: "◎", 0.5% or less: "○", below 1.0%: "Δ", 1.0% or more: "x".

Example 1

An $Al_2O_3$ particle having about 47 μm of mean particle diameter, a titanium (Ti) powder having about 10 μm of mean particle diameter, and aluminum to be melt-infiltrated (Al) (commercially available pure Al (A1050, purity>99.5%)) were prepared. Next, titanium (Ti) powder and the $Al_2O_3$ particles were mixed in a ($Ti/Al_2O_3$) volume ratio of 0.53, and the resultant was mixed in a V type mixer. A mixed material obtained by mixing was filled in a container made of carbon having 50 mm ϕ of inside diameter, and compression-molded in the form of a shape corresponding to a shape of the container to obtain a formed body having approximately 49% of porosity. Subsequently, a lid member made of carbon having holes (routing holes) with 10 mm ϕ of inside diameter was placed on an upper face of the formed body, the lid member was fixed with a container made of carbon which was placed on the outer portion thereof, and then aluminum (Al) (solid) was placed thereon so as to make molten aluminum (Al) flow into through the holes. The container was heated up to 700° C. under 0.013 Pa or less of vacuum atmosphere, molten aluminum (Al) was infiltrated under pressureless condition, and the condition was maintained for approximately one hour, then slowly cooled to obtain a composite material (Example 1). It has been found that aluminum was infiltrated in a good condition until the end portion of the composite material formed in the shape in cope with the space surrounded by the container and said lid when the cross section of a sample specimen cut from the resultant composite material and having been polished was subjected to the optical microscopic examination. Table 2 shows measurement results of an open porosity (%), density and a four-point bending strength.

Comparative Example 1

Except that aluminum (Al) was melt-infiltrated from whole surface of the upper face of a formed body without using a lid member, the same operation as that in Example 1 was repeated to produce a composite material (Comparative Example 1). Table 2 shows measurement results of an open porosity (%), density and a four-point bending strength.

Comparative Example 2

A composite material was produced by pressurized infiltration of molten aluminum (Al) using a hot press (HP) method. That is, except that a lid member was not used and pressure of about 30 MPa was applied at the time of pressurized infiltration of aluminum (Al), the same operation as that in Example 1 was repeated, and a composite material was produced (Comparative Example 2). Table 2 shows measurement results of an open porosity (%), density and a four-point bending strength.

TABLE 2

| | Open porosity (%) | Density ($g/cm^2$) | Four-point bending strength (MPa) |
|---|---|---|---|
| Example 1 | 0.03 | 3.44 | 421 |
| Comparative Example 1 | 0.45 | 3.38 | 218 |
| Comparative Example 2 | 0.09 | 3.42 | 230 |

According to results shown in Table 2, it became clear that since the formed body was fixed by the lid member (Example 1), pressureless infiltration of the molten aluminum (Al) was conducted to the pores of inside of the formed body, and that the composite material was spontaneously made dense. Furthermore, as in Example 1, since spontaneous infiltration phenomenon of aluminum (Al) using heat of reaction occurred, an open porosity equivalent to a case where a composite material is compulsorily made dense by HP method as shown in Comparative Example 2 was obtained. Therefore, the composite material according to Example 1 is higher in the density, and has an improved dense characteristic, compared with the composite material according to Comparative Example 1. Besides, in four-point bending strength, the composite material of Example 1 has a high strength of 400 MPa or more in contrast to the composite material in Comparative Examples 1 and 2 having a strength of about 200 MPa, respectively. This is considered to be originated in that closed pores inside the composite material decreased and that dispersing material/matrix interface strength increased. Therefore, according to the present invention, a more compacted composite material can be produced by using internal energy, which probably contribute to reduction of energy cost for composite material producing.

Examples 2 through 29, Comparative Examples 3 through 7

An $Al_2O_3$ particle having mean particle diameters shown in Table 3, titanium (Ti) powder, and aluminum (Al) to be melt-infiltrated (commercially available pure Al (A1050, purity>99.5%)) were prepared. Subsequently, the titanium (Ti) powder and the $Al_2O_3$ particle were mixed so that a value ($Ti/Al_2O_3$) might give values shown in Table 3, and were mixed in V type mixer. Mixed materials obtained by mixing were filled in a container made of carbon having 50 mm ϕ of inside diameter to obtain a formed body having porosities shown in Table 3 with a form corresponding to a shape of the container.

Subsequently, a lid member made of carbon having-holes with 10 mm ϕ of inside diameter was placed on an upper face of the formed body, and the aluminum (Al) (solid) was placed so that molten aluminum (Al) might flow into the holes. The container was heated up to 700° C. under 0.013 Pa of vacuum atmosphere, molten aluminum (Al) was infiltrated under pressureless condition, and the condition was maintained for approximately one hour, then slowly cooled to obtain a composite material (Examples 2 through 29, Comparative Examples 3 through 7). Table 3 shows evaluation results of infiltration ability and dense characteristic.

TABLE 3

| | Dispersing material (ceramic particle) | | Metal powder | | | | | |
|---|---|---|---|---|---|---|---|---|
| | Kind | Mean particle diameter (μm) | Kind | Mean particle diameter (μm) | Ti/$Al_2O_3$ (volume fraction) | Porosity (%) | Infiltration ability | Dense characteristic |
| Ex. 2 | $Al_2O_3$ | 47 | Ti | 10 | I | 55 | ○ | ◎ |
| Ex. 3 | $Al_2O_3$ | 47 | Ti | 10 | 0.87 | 52 | ◎ | ◎ |
| Ex. 4 | $Al_2O_3$ | 47 | Ti | 10 | 0.53 | 50 | ◎ | ◎ |
| Ex. 5 | $Al_2O_3$ | 47 | Ti | 10 | 0.4 | 49 | ◎ | ◎ |
| Ex. 6 | $Al_2O_3$ | 47 | Ti | 10 | 0.27 | 48 | ◎ | ◎ |
| Ex. 7 | $Al_2O_3$ | 47 | Ti | 10 | 0.18 | 48 | ◎ | ◎ |
| Ex. 8 | $Al_2O_3$ | 47 | Ti | 10 | 0.14 | 47 | ◎ | ○ |
| Ex. 9 | $Al_2O_3$ | 47 | Ti | 10 | 0.1 | 45 | ○ | Δ |
| Ex. 10 | $Al_2O_3$ | 47 | Ti | 10 | 0.53 | 70 | ○ | Δ |
| Ex. 11 | $Al_2O_3$ | 47 | Ti | 10 | 0.53 | 60 | ◎ | ◎ |
| Ex. 12 | $Al_2O_3$ | 47 | Ti | 10 | 0.53 | 45 | ◎ | ◎ |
| Ex. 13 | $Al_2O_3$ | 47 | Ti | 10 | 0.53 | 35 | ○ | ○ |
| Com. Ex. 3 | $Al_2O_3$ | 47 | Ti | 10 | 0.53 | 25 | x | Δ |
| Ex. 14 | $Al_2O_3$ | 47 | Ti | 10 | 2 | 69 | ◎ | ◎ |
| Com. Ex. 4 | $Al_2O_3$ | 47 | Ti | 10 | 2 | 45 | x | Δ |
| Ex. 15 | $Al_2O_3$ | 47 | Ti | 10 | 1 | 65 | ◎ | ◎ |
| Ex. 16 | $Al_2O_3$ | 47 | Ti | 10 | 1 | 50 | ○ | ◎ |
| Com. Ex. 5 | $Al_2O_3$ | 47 | Ti | 10 | 1 | 35 | x | Δ |
| Ex. 17 | $Al_2O_3$ | 47 | Ti | 10 | 0.18 | 40 | ◎ | ◎ |
| Ex. 18 | $Al_2O_3$ | 47 | Ti | 10 | 0.18 | 35 | ○ | ◎ |
| Ex. 19 | $Al_2O_3$ | 47 | Ti | 10 | 0.14 | 40 | ◎ | ◎ |
| Ex. 20 | $Al_2O_3$ | 47 | Ti | 10 | 0.14 | 35 | ○ | ◎ |
| Ex. 21 | $Al_2O_3$ | 47 | Ti | 10 | 0.14 | 25 | ○ | Δ |
| Com. Ex. 6 | $Al_2O_3$ | 47 | Ti | 10 | 0.1 | 60 | Δ | x |
| Com. Ex. 7 | $Al_2O_3$ | 47 | Ti | 10 | 0.1 | 20 | x | Δ |
| Ex. 22 | $Al_2O_3$ | 47 | Ti | 20 | 1 | 58 | ○ | ◎ |
| Ex. 23 | $Al_2O_3$ | 47 | Ti | 20 | 0.53 | 51 | ◎ | ◎ |
| Ex. 24 | $Al_2O_3$ | 47 | Ti | 20 | 0.4 | 50 | ◎ | ○ |
| Ex. 25 | $Al_2O_3$ | 80 | Ti | 20 | 1 | 60 | ○ | ◎ |
| Ex. 26 | $Al_2O_3$ | 80 | Ti | 20 | 0.53 | 53 | ◎ | ◎ |
| Ex. 27 | $Al_2O_3$ | 80 | Ti | 20 | 0.4 | 51 | ◎ | ○ |
| Ex. 28 | $Al_2O_3$ | 30 | Ti | 10 | 0.53 | 53 | ◎ | ◎ |
| Ex. 29 | $Al_2O_3$ | 10 | Ti | 10 | 1 | 58 | ○ | ◎ |

From results shown in Table 3, even if the volume ratio of (Ti/$Al_2O_3$) was large, when a porosity was small in a certain extent, it became clear that the infiltration ability of aluminum (Al) fell. Besides, since there was too little quantity of titanium (Ti) powder used as driving force of infiltration when the volume ratio of (Ti/Al203) was small, it became clear that an open pore ratio of the composite material obtained increased. Therefore, it became clear that a composite material having densified fine structure might be appropriately produced by specifying the relation between a volume ratio of (Ti/$Al_2O_3$) and a porosity.

Examples 30 through 35

Except that a mean particle diameter of $Al_2O_3$ particle was set to approximately 47 μm, a mean particle diameter of titanium (Ti) powder was set to about 10 μm, and volume ratios of (Ti/$Al_2O_3$) and porosities of mixed materials were set as the values shown in Table 4, the same operation as that in Examples 2 through 29 was repeated, and composite materials were produced (Examples 30 through 35). Table 4 shows analysis results of matrix composition, and measurement results of a infiltration ratio, an open porosity, a four-point bending strength, a Young's modulus, and a fracture toughness value. Besides, scanning electron microscope photographs showing microstructure of the composite material in Example 30 (magnification×100, ×500) and scanning electron microscope photographs showing microstructure of the composite material of Example 34 (magnification×100, ×500) are shown in FIGS. 5 through 8. In addition, in "porosity" in Table 4, "before infiltration" means porosity calculated from a formed body thickness after molding, and "after infiltration" means a actual porosity calculated from a thickness of obtained composite material after the infiltration.

Comparative Examples 8 and 9

An $Al_2O_3$ particle having 47 μm of mean particle diameter as a dispersing material pressed and molded under a pressure of approximately 80 MPa using an uniaxial pressing machine to produce a formed body. This formed body was beforehand heated at 760° C. in the atmosphere, and subsequently was placed in a mold having been heated previously at 500° C. Then commercially available pure aluminum (Al) (A1050) molten at 850° C. was introduced in a mold, and pressurized infiltration was conducted under a pressure of 50 MPa to produce a composite material (Comparative Example 8). Besides, Al alloy (A5052 (Al-2.5% Mg in terms of mass percent)) was prepared as Comparative Example 9. Table 4 shows the physical characteristics of thus obtained composite materials.

Comparative Examples 10 and 11

Figure 9:
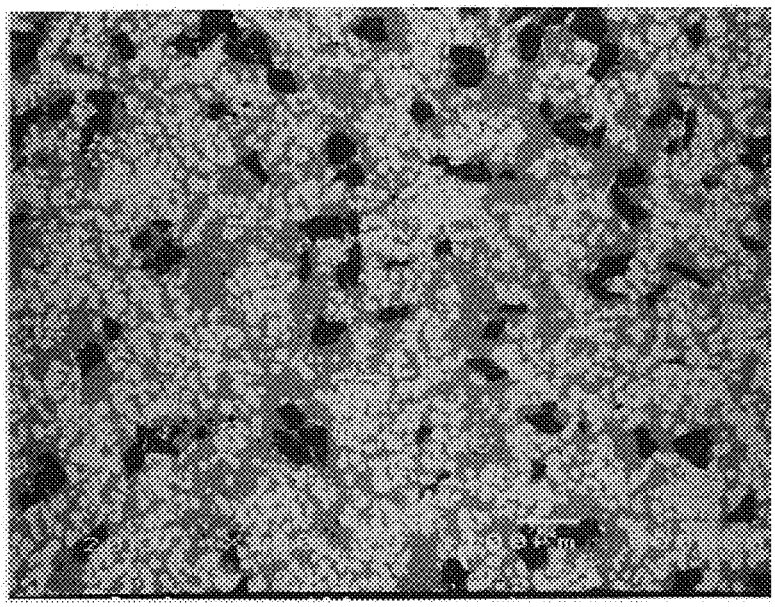
FIG. 9 is a scanning electron microscope photograph (magnification×100) in which a microstructure of a composite material of Comparative Example 10 is shown.
Figure 10:
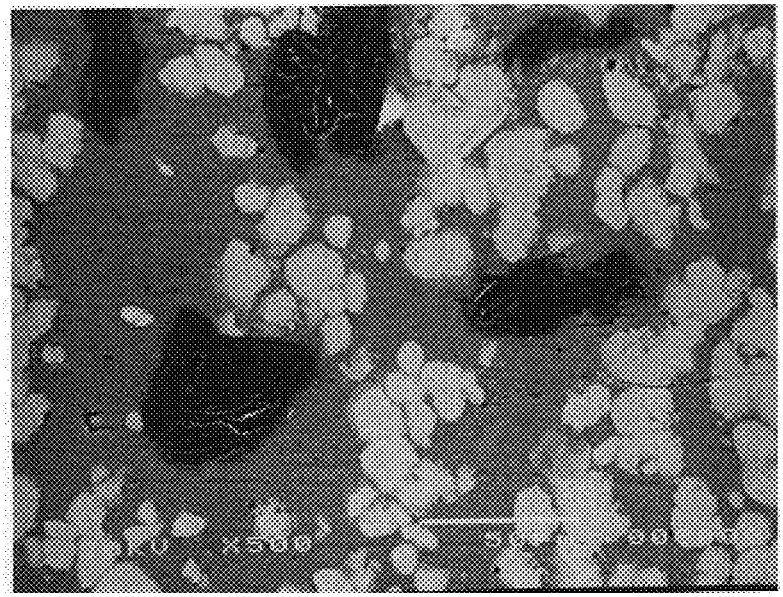
FIG. 10 is a scanning electron microscope photograph (magnification×500) in which a microstructure of a composite material of Comparative Example 10 is shown.

An $Al_2O_3$ particle having a 47 μm of mean particle diameter as a dispersing material, and a titanium (Ti) powder having a 45 μm of mean particle diameter were mixed in a (Ti/$Al_2O_3$) volume ratio of 1.0, and then was pressed and molded using a uniaxial press machine under a pressure of approximately 100 MPa to produce a formed body having a diameter of 34 mm ϕ×6 mm and approximately 30% of porosity. This formed body was immersed, under 0.013 Pa of vacuum atmosphere, into aluminum (Al) alloy (A5052) heated and molten up to 850° C., and thus pressureless infiltration of the molten aluminum (Al) alloy was conducted into the formed body to produce a composite material (Comparative Example 10). Besides, except that SiC particle having approximately 50 μm of mean particle diameter was used as a dispersing material instead of $Al_2O_3$ particle, then was mixed in a (Ti/ceramics) volume ratio of 1.0, a formed body having a diameter of 34 mm ϕ×7.5 mm and approximately 30% of porosity was produced and was used, the same operation as that in a case of the above described Comparative Example 10 was repeated to produce a composite material (Comparative Example 11). Table 4 shows the physical characteristics of thus obtained composite materials. In addition, scanning electron microscope photographs (magnification×100, ×500) showing microstructures of the composite material in Comparative Example 10 are shown in FIGS. 9 and 10.

TABLE 4

| | Dispersing material (Ceramic particle) | | Metal powder | | | | | | Matrix composition | | | | | | |
|---|---|---|---|---|---|---|---|---|---|---|---|---|---|---|---|
| | Kind | Mean particle diameter (μm) | Kind | Mean particle diameter (μm) | Ti/Ceramic *1 (volume fraction) | Porosity Before infiltration (%) | Porosity After infiltration (%) | Particle volume fraction (% by volume) | Aluminjide intermetalic compound (mass %) | Aluminum (mass %) | Infiltration ratio (%) | Open porosity (%) | Four-point bending strength (MPa) | Young's modulus (GPa) | Fracture toughness value (MPa-m$^{1/2}$) |
| Ex. 30 | $Al_2O_3$ | 47 | Ti | 10 | 0.53 | 51.2 | 52.6 | 31 | 94.1 | 5.9 | 100 | 0.02 | 450 | 215 | 6.2 |
| Ex. 31 | $Al_2O_3$ | 47 | Ti | 10 | 0.4 | 49.8 | 50.7 | 35 | 87.8 | 12.2 | 100 | 0.04 | 404 | 212 | 7.4 |
| Ex. 32 | $Al_2O_3$ | 47 | Ti | 10 | 0.27 | 48.4 | 48.9 | 40 | 75 | 25 | 100 | 0.05 | 390 | 208 | 8.5 |
| Ex. 33 | $Al_2O_3$ | 47 | Ti | 10 | 0.18 | 46.2 | 46.9 | 45 | 61.6 | 38.4 | 100 | 0.09 | 382 | 198 | 10.3 |
| Ex. 34 | $Al_2O_3$ | 47 | Ti | 10 | 0.14 | 44.6 | 44.8 | 48 | 56.9 | 43.1 | 100 | 0.75 | 373 | 193 | 11.2 |
| Ex. 35 | $Al_2O_3$ | 47 | Ti | 10 | 0.1 | 43.5 | 43.7 | 51 | 44 | 56 | 100 | 5 | — | — | — |
| Com. Ex. 8 | $Al_2O_3$ | 47 | — | — | — | — | — | 40 | — | 100 | — | 0.06 | — | 120 | 16.3 |
| Com. Ex. 9 | — | — | — | — | — | — | — | — | — | — | — | — | — | 71 | — |
| Com. Ex. 10 | $Al_2O_3$ | 47 | Ti | 45 | 1 | 30 | 83.5 | 8 | 39.6 | 60.4 | — | — | — | — | — |
| Com. Ex. 11 | SiC | 50 | Ti | 45 | 1 | 30 | 84.2 | 9 | 42.2 | 57.8 | — | — | — | — | — |

*1: or $Ti/Al_2O_3$ (volume fraction)

From results shown in Table 4, when the volume ratios of ($Ti/Al_2O_3$) were varied within a predetermined range (Examples 30 through 35), composite materials having 100% of infiltration ratio could be produced. However, when the volume ratios of ($Ti/Al_2O_3$) was set to a lower volume ratio of 0.10, it was observed that a reduction in an amount of Ti powder used as infiltration driving force increased an open porosity. Besides, as shown in FIGS. 5 through 8, it became clear that an $Al_2O_3$ particle volume fraction of a composite material, and matrix composition (aluminide intermetallic compound and Al phase) were controllable by varying a value ($Ti/Al_2O_3$). Thus, it is evident that the technique according to the Examples of the present invention may control the various aspects of physical characteristics of a composite material only by controlling $Al_1O_3$ particle volume fraction in the composite material, if one compares those of Comparative Example 8.

Especially, although an aluminide intermetallic compound has a low fracture toughness value while it has a high rigidity as compared with an aluminum (Al), in the present invention as shown in Table 4, the content of aluminum (Al) capable of acting as a fracture resistance during the crack propagation could be increased by setting a volume ratio of ($Ti/Al_2O_3$) at a small one, thereby a composite material having a significantly improved fracture toughness value was obtained. Furthermore, the Young's modulus of each of the composite materials according to the present Examples was high and around 200 Gpa since they contained aluminide intermetallic compound in addition to $Al_2O_3$ particles in the matrix, compared with the metal matrix composite material of Comparative Example 8 in which the matrix was produced only from aluminum according to an infiltration method under pressure, or the aluminum alloy according to Comparative Example 9.

The composite materials in Comparative Examples 10 and 11 were obtained by immersing a formed body comprising a dispersing material and a titanium (Ti) powder in molten aluminum (Al) alloy, and here pressureless infiltration as shown in FIG. 9 was possible. However, the particle volume fraction and matrix composition after infiltration of the composite material in Comparative Example 10 wherein the volume ratio of (Ti/ceramics) was made to be 1.0, did not show. a target value at the beginning (See Table 4) since $Al_2O_3$ particle volume fraction in the composite material was decreased and the amount of aluminum contained in the matrix became excessive, as is clear from the microstructure shown in microscope photograph of FIG. 9, compared with the microstructures of the composite materials according to Examples 30 and 34, wherein the content of titanium was decreased so as to make the volume ratios of (Ti/ceramics) to be 0.53 or 0.14, shown in microscope photographs of FIGS. 5 and 7. This would be probably because the expansion of a green formed body that was caused by heat generation at the time of infiltration, as a result, an excessive amount of molten aluminum was supplied thereto, and this would result in making the porosity varied significantly. Therefore, although the composite materials in Comparative Examples 10 and 11 were produced by pressureless infiltration, they were accompanied by difficulty in control of a particle volume fraction and a matrix composition. On the other hand, in the composite materials in Examples 30 through 35, since the formed body was fixed at the time of infiltration and the value ($Ti/Al_2O_3$) and the porosity were specified in a suitable relationship, composite materials having desired material compositions and densified fine structure were obtained.

Examples 36 through 62

A titanium (Ti) powder was mixed in the volume ratio of (Ti/ceramics) (or ($Ti/Al_2O_3$)) with a dispersing material (ceramic particle) as shown in Table 5, and the resultant was mixed using a V type mixer. Mixed materials obtained by mixing were filled in a container made of carbon having 50 mm ϕ of inside diameter and the respective formed bodies having a porosity shown in Table 5 was compression-molded in the form copying the shape of the container. Subsequently, a lid member made of carbon having holes with 10 mm ϕ of inside diameter was placed over the upper face of the formed body, the lid member was fixed with a container made of carbon which was placed the outer portion of the lid member, and aluminum (Al) or an aluminum (Al) alloy (both solid) was placed on the lid member so as to make molten aluminum (Al) (A1050) or molten aluminum (Al) alloy (A5052) flow into the holes. The container was heated up to 700° C. under a vacuum atmosphere of 0.013 Pa or less, or 13 Pa or less, thus the aluminum (Al) (A1050) or aluminum (Al) alloy (A5052) was infiltrated under pressureless condition, and the condition was maintained for approximately one hour, then the container was slowly cooled to obtain composite materials (Examples 36 through 62). Table 5 shows results of evaluation on infiltration ability and a dense characteristic.

TABLE 5

| | Dispersing material (ceramic particle) | | Metal powder | | Ti/ | | | Infil- | | |
|---|---|---|---|---|---|---|---|---|---|---|
| | Kind | Mean particle diameter (μm) | Kind | Mean particle diameter (μm) | Ceramic *1 (volume fraction) | Porosity (%) | Al or Al alloy | tration atmos-phere (Pa) | Infil-tration ability | dense charac-teristic |
| Ex. 36 | SiC | 50 | Ti | 10 | 1 | 58 | A1050 | <0.013 | ○ | ◎ |
| Ex. 37 | SiC | 50 | Ti | 10 | 0.53 | 51 | A1050 | <0.013 | ◎ | ◎ |
| Ex. 38 | SiC | 50 | Ti | 10 | 0.27 | 46 | A1050 | <0.013 | ◎ | ◎ |
| Ex. 39 | AlN | 40 | Ti | 10 | 1 | 60 | A1050 | <0.013 | ○ | ◎ |
| Ex. 40 | AlN | 40 | Ti | 10 | 0.53 | 53 | A1050 | <0.013 | ◎ | ◎ |
| Ex. 41 | AlN | 40 | Ti | 10 | 0.27 | 45 | A1050 | <0.013 | ◎ | ◎ |
| Ex. 42 | $Si_3N_4$ | 45 | Ti | 10 | 1 | 61 | A1050 | <0.013 | ○ | ◎ |
| Ex. 43 | $Si_3N_4$ | 45 | Ti | 10 | 0.53 | 51 | A1050 | <0.013 | ◎ | ◎ |
| Ex. 44 | $Si_3N_4$ | 45 | Ti | 10 | 0.27 | 46 | A1050 | <13 | ◎ | ◎ |
| Ex. 45 | $Al_2O_3$ | 47 | Ti | 10 | 1 | 55 | A1050 | <13 | ○ | ◎ |
| Ex. 46 | $Al_2O_3$ | 47 | Ti | 10 | 0.87 | 52 | A1050 | <13 | ◎ | ◎ |
| Ex. 47 | $Al_2O_3$ | 47 | Ti | 10 | 0.53 | 50 | A1050 | <13 | ◎ | ◎ |
| Ex. 48 | $Al_2O_3$ | 47 | Ti | 10 | 0.4 | 49 | A1050 | <13 | ◎ | ◎ |
| Ex. 49 | $Al_2O_3$ | 47 | Ti | 10 | 0.27 | 48 | A1050 | <13 | ◎ | ○ |
| Ex. 50 | $Al_2O_3$ | 47 | Ti | 10 | 0.18 | 48 | A1050 | <13 | ◎ | ○ |
| Ex. 51 | $Al_2O_3$ | 47 | Ti | 10 | 0.14 | 47 | A1050 | <13 | ◎ | Δ |
| Ex. 52 | $Al_2O_3$ | 47 | Ti | 10 | 1 | 55 | A5052 | <0.013 | ○ | ◎ |
| Ex. 53 | $Al_2O_3$ | 47 | Ti | 10 | 0.87 | 52 | A5052 | <10.03 | ◎ | ◎ |
| Ex. 54 | $Al_2O_3$ | 47 | Ti | 10 | 0.53 | 50 | A5052 | <0.013 | ◎ | ◎ |
| Ex. 55 | $Al_2O_3$ | 47 | Ti | 10 | 0.27 | 48 | A5052 | <0.013 | ◎ | ◎ |
| Ex. 56 | $Al_2O_3$ | 47 | Ti | 10 | 0.14 | 47 | A5052 | <0.013 | ◎ | ○ |
| Ex. 57 | $Al_2O_3$ | 47 | Ti | 10 | 0.1 | 45 | A5052 | <10.03 | ○ | Δ |
| Ex. 58 | $Al_2O_3$ | 47 | Ti | 10 | 1 | 55 | A5052 | <13 | ○ | ◎ |
| Ex. 59 | $Al_2O_3$ | 47 | Ti | 10 | 0.87 | 52 | A5052 | <13 | ◎ | ◎ |
| Ex. 60 | $Al_2O_3$ | 47 | Ti | 10 | 0.27 | 48 | A5052 | <13 | ◎ | ◎ |
| Ex. 61 | $Al_2O_3$ | 47 | Ti | 10 | 0.18 | 48 | A5052 | <13 | ◎ | ◎ |
| Ex. 62 | $Al_2O_3$ | 47 | Ti | 10 | 0.14 | 47 | A5052 | <13 | ◎ | ○ |

*1: or $Ti/Al_2O_3$ (volume fraction)

As is clear from results shown in Table 5, when SiC as carbide, and AlN and $Si_3N_4$ as nitride were used as dispersing material, the production of a composite material was also possible. Besides, although infiltration was satisfactorily carried out when infiltration atmosphere was set as a low vacuum atmosphere of 13 Pa or less by pumping out roughly air contained therein with a rotary pump. Moreover, when an aluminum (Al) alloy was used, composite materials having a densified fine structure could be produced even in a lower volume ratio of (Ti/ceramics), and a reduced atmosphere of 13 Pa or less, where there is a fear of occurring the oxidization of aluminum (Al) and titanium (Ti). This is probably because magnesium (Mg) included in an aluminum (Al) alloy demonstrated an effect of reducing oxide film produced on an aluminum (Al) surface.

Examples 63 through 69

An $Al_2O_3$ particle having approximately 47 μm of mean particle diameter, a titanium (Ti) powder having approximately 10 μm of mean particle diameter, and aluminum (Al) (A1050) to be melt-infiltrated were used, the volume ratios of ($Ti/Al_2O_3$) and each porosity of mixed materials (formed body) was set to values shown in Table 6, and the same operation as that in Examples 2 through 29 was repeated to produce composite materials (Examples 63 through 69). In addition, maximum infiltrated distances of the aluminum (Al) to be melt-infiltrated were set to 100 mm, and inside diameters of holes were set to 20 mm. Table 6 shows measurement results of infiltration ratio.

TABLE 6

| | $Ti/Al_2O_3$ (volume fraction) | Porosity (%) | Routing hole inside diameter (X: mm) | X/Y | Infiltration ratio (%) |
|---|---|---|---|---|---|
| Example 63 | 0.87 | 52 | 20 | 0.2 | 51 |
| Example 64 | 0.53 | 50 | 20 | 0.2 | 63 |
| Example 65 | 0.27 | 48 | 20 | 0.2 | 82 |

TABLE 6-continued

| | $Ti/Al_2O_3$ (volume fraction) | Porosity (%) | Routing hole inside diameter (X: mm) | X/Y | Infiltration ratio (%) |
|---|---|---|---|---|---|
| Example 66 | 0.14 | 47 | 20 | 0.2 | 94 |
| Example 67 | 1 | 65 | 20 | 0.2 | 52 |
| Example 68 | 0.53 | 59 | 20 | 0.2 | 79 |
| Example 69 | 0.27 | 42 | 20 | 0.2 | 93 |

It became clear that an infiltration ratio improved, especially when the volume ratio of ($Ti/Al_2O_3$) was set small as clearly shown in results in Table 6. Besides, an increase in a porosity, when the volume ratio of ($Ti/Al_2O_3$) was set larger, and decrease in a porosity, when the volume ratio of ($Ti/Al_2O_3$) was set smaller were proven to be effective in improving the infiltration ratio.

Examples 70 through 73, Comparative Examples 12 and 13

An $Al_2O_3$ particle having approximately 47 $\mu$m of mean particle diameter, a titanium (Ti) powder having approximately 10 $\mu$m of mean particle diameter, and aluminum (Al) (A1050) to be melt-infiltrated were used, the volume ratio of ($Ti/Al_2O_3$) was set to 0.27, a porosity of a mixed material (formed body) was set to 48%, and similar operation as Examples 2 to 29 was repeated to produce composite materials (Examples 70 through 73). In addition, a maximum infiltrated distance of the aluminum (Al) to be melt-infiltrated was fixed to 100 mm. The results of evaluation on infiltration ability are shown in Table 7. In addition, in "evaluation on infiltration ability" in Table 7, after the obtained composite material was cut and its cross section was ground, observation by an optical microscope and SEM was conducted, and it was observed and evaluated whether infiltration was uniformly advanced in a mixed material to obtain a result.

TABLE 7

| | $Ti/Al_2O_3$ (volume fraction) | Porosity (%) | Routing hole inside diameter (X: mm) | X/Y | Evaluation on infiltration ability |
|---|---|---|---|---|---|
| Comparative Example 12 | 0.27 | 48 | 5 | 0.05 | Non-infiltrated portion observed at endmost part |
| Example 70 | 0.27 | 48 | 8 | 0.08 | Satisfactory |
| Example 71 | 0.27 | 48 | 10 | 0.1 | Satisfactory |
| Example 72 | 0.27 | 48 | 20 | 0.2 | Satisfactory |
| Example 73 | 0.27 | 48 | 40 | 0.4 | Satisfactory |
| Comparative Example 13 | 0.27 | 48 | 60 | 0.6 | Infiltrated, but dense characteristic was decreased |

As is clear from results shown in Table 7, although formation of a non-infiltrated portion was not observed when X/Y was set in a range of 0.08 through 0.4, formation of a non-infiltrated portion was observed when X/Y was set below 0.08. Besides, when X/Y was set beyond 0.4, it became clear that dense characteristic of the obtained composite material decreased.

Example 74

An $Al_2O_3$ particle having approximately 47 $\mu$m of mean particle diameter, a titanium (Ti) powder having approximately 10 $\mu$m of mean particle diameter, and an aluminum (Al) alloy (A5052) to be melt-infiltrated were prepared. Subsequently, the titanium (Ti) powder and the $Al_2O_3$ particle were mixed in the ($Ti/Al_2O_3$) volume ratio of 0.27, and mixed using a V type mixer. Mixed materials obtained by mixing were filled in a container made of carbon having 100 mm $\phi$ of inside diameter, and compression-molded a formed body having a thickness of 30 mm, a porosity of 48.1% and a shape copying the shape of the container. Subsequently, a lid member made of high-density carbon having seven holes (20 mm $\phi$ of inside diameter) was placed on an upper face of the formed body, and an aluminum (Al) alloy was placed so as to make molten aluminum (Al) flow into the holes. The container was heated up to 800° C. under 0.013 Pa of vacuum atmosphere to conduct pressureless infiltration of molten aluminum (Al) alloy, it was maintained for approximately one hour at the temperature, and then slowly cooled to obtain composite material (Example 74).

After the obtained composite material was cut and its cross section was ground, observation by an optical microscope and SEM was conducted, pores were not observed and the infiltration ability in the mixed material was also very satisfactory. Therefore, when infiltration of aluminum (Al) was conducted through not one hole, but a plurality of holes, it was confirmed that a satisfactory composite material was obtained.

Example 75

The same operation as that in Example 1 was repeated to produce a composite material (Example 75) except that a mixed material was additionally filled in the lower part of the inner portion of the holes. Accordingly, a composite material having more homogeneous composition was producible, without forming inhomogeneous microstructure where infiltration of the aluminum (Al) was excessively given in a portion directly under the holes.

Examples 76 through 79

An $Al_2O_3$ particle having approximately 47 $\mu$m of mean particle diameter, a titanium (Ti) powder having approximately 10 $\mu$m of mean particle diameter, and an aluminum (Al) alloy (A5052) to be melt-infiltrated were prepared. Then, tin powder and aluminum Particles were compounded in the ($Ti/Al_2O_3$) volume ratio of 0.27, and the resultant was mixed in a V type mixer. The resultant mixed material was filled into a mold type of container 30 made of SUS316 that had inside dimension with a length of 100 mm×width of 100 mm as shown in FIG. 11, and had high-density carbon installed in inner wall thereof. Thereafter, the mixture was subjected to a compression-molding to obtain a formed body copying the shape, and the formed body having a thickness of 30 mm, and a porosity of 48.1%. Subsequently, a lid member made of high-density carbon having seven holes (20 mm $\phi$ of inside diameter) was placed on an upper face of the formed body, and an aluminum (Al) alloy was placed so as to make molten aluminum (Al) flow into the holes. The container was heated up to 800° C. under 0.013 Pa of vacuum atmosphere to conduct pressureless infiltration of molten aluminum (Al) alloy, it was maintained for approximately one hour at the temperature, and then slowly cooled to obtain composite material (Example 76). The same operation as in Example 76 was repeated to produce composite materials except that the ($Ti/Al_2O_3$) volume ratios of the respective composite materials were set at 0.18, 0.40, or 0.53, respectively (Examples 77 through 79). As a result, the produced composite materials were easily removed from the carbon material 22 after the mold type container 30 made of SUS316 was disassembled, showing extremely superior mold-release characteristic from the reaction container.

Example 80

Figure 12A:
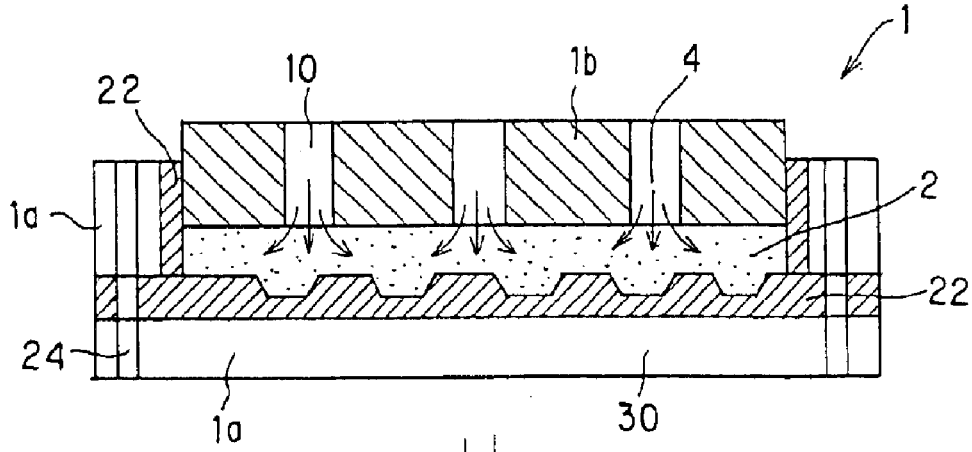
FIGS. 12(*a*) and (*b*) show a pattern diagram illustrating still another example of a method for producing a composite material of the present invention, and FIG. 12(*a*) is a schematic showing how to prepare the present composite material as a still another embodiment and FIG. 12(*b*) is a schematic showing of a composite material of the present invention, as a still another embodiment.
Figure 12B:
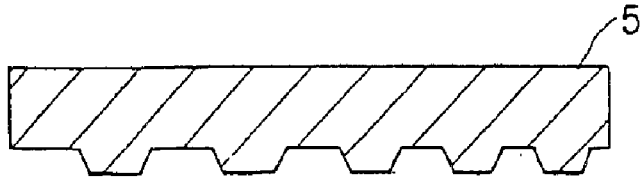

Except for using a mold type container 30 that had a length of 100 mm×width of 100 mm as shown in FIG. 12(*a*), and a bottom of a concavo-convex shape, and that had carbon material 22 consisting of high-density carbon installed in inner wall, the same operation as that in Example 76 was repeated to produce a composite material (Example 80). Accordingly, a composite material having outstanding mold-release characteristic from a reaction container, and complicated shape as shown in FIG. 12(*b*) could be produced.

Example 81

An $Al_2O_3$ particle having approximately 47 $\mu$m of mean particle diameter, a titanium (Ti) powder having approximately 10 $\mu$m of mean particle diameter, and an aluminum (Al) alloy (A5052) to be melt-infiltrated were prepared. Subsequently, the titanium (Ti) powder and the $Al_2O_3$ particle were mixed in the ($Ti/Al_2O_3$) volume ratio of 0.27, and mixed using a V type mixer. The mixed material obtained by mixing was filled in a mold type of container made of SUS316 with high-density carbon installed in inner wall thereof having inside diameter of 300 mm $\phi$, and was molded to give a formed body having a porosity of 48.1%, and a form copying the shape of the container. Subsequently, a lid member made of high-density carbon having 61 holes (20 mm $\phi$) or 12 holes (15 mm $\phi$) was placed on an upper face of the formed body, and the aluminum (Al) alloy was placed so as to make molten aluminum (Al) alloy flow into the holes. Soaking at 600° C. for one hour was given to the container under vacuum atmosphere of 1.3 Pa or less, then heated up to 800° C. to conduct pressureless condition of the molten aluminum (Al) alloy. After the container was maintained at the temperature for approximately one hour, cooled slowly to obtain a large-sized composite material (Example 81).

When the obtained 300 mm $\phi$×30 mm composite material was arbitrarily cut and each cut face was observed, in general, satisfactory composite material materialization state was observed with no notable pores recognized in any cut faces. Therefore, according to the present invention, it was confirmed that produce of a large-sized composite material that was difficult to be produced by conventional methods was possible.

Example 82

The same operation as that in Example 81 was repeated except that a lid member (container element 1*b*) made of carbon and having the hole 10 being formed by an annular member 15 made of porous carbon that was easy to be broken even under a low stress, as shown in FIG. 4, was used to produce a composite material (Example 82).

As a result, since the aluminum (Al) remaining inside the holes and acted as shrinkage resistance broke the annular member 15 by thermal shrinkage of the composite material during slow cooling after infiltration of molten aluminum (Al), no fault in which a crack was formed in the portion directly under the holes of the obtained composite material was observed.

Example 83

Except for using a reaction container 1 having inside dimension with a length of 100 mm×width of 100 mm×depth of 60 mm, a plurality of holes 10 in upper part, runner channels 23 with a shape of a slope inclining toward a lower part from an upper part of the reaction container 1 in side part thereof, and a plurality of holes 20 communicating with the runner channels 23 as shown in FIG. 13, the same operation as that in Example 76 was repeated to produce a composite material (Example 83). As a result, though it was thick, a composite material having a densified fine structure to endmost portion could be produced.

Example 84

Figure 14A:
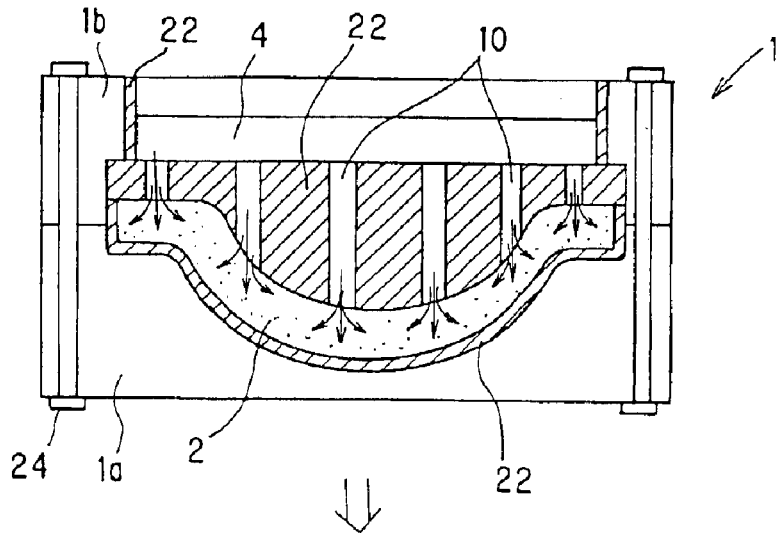
FIGS. 14(*a*) and (*b*) show a pattern diagram illustrating still another example of a method for producing a composite material of the present invention, and FIG. 14(*a*) is a schematic showing how to prepare the present composite material as a still another embodiment and FIG. 14(*b*) is a schematic showing of a composite material of the present invention, as a still another embodiment.
Figure 14B:
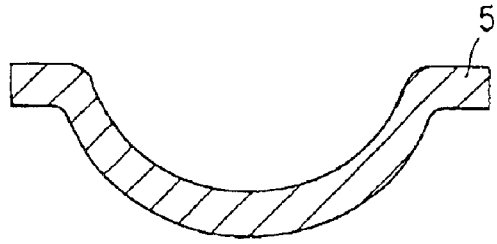

Except for using a reaction container 1 having a complicated and bent inside shape as shown in FIG. 14(*a*), the same operation as that in Example 76 was repeated to produce a composite material (Example 84). As a result, a composite material 5 having a complicated shape as shown in FIG. 14(*b*) was producible.

As is described above, in a composite material of the present invention, a mixed material including a predetermined metal powder and a predetermined dispersing material are filled into a predetermined reaction container, Aluminum (Al) is melt-infiltrated to pores inside the mixed material through predetermined holes, while the mixed material is fixed, and thus the dispersing material is dispersed in a matrix, and thereby a densified fine structure is easily formed leading to reduction of producing cost.

Besides, according to a method for producing a composite material of the present invention, a mixed material including a predetermined metal powder and a dispersing material are filled into a predetermined reaction container, Aluminum (Al) is melt-infiltrated to pores inside the mixed material through predetermined holes, while the mixed material is fixed, to produce a composite material having a dispersing material dispersed in matrix, and thereby producing processes are reduced, simultaneously a desired shape, especially, large-sized and complicated shape may be obtained, and a composite material having a densified fine structure may be easily produced.

What is claimed is:

1. A composite material producible by filling a mixed material containing a metal powder capable of inducing a self-combustion reaction upon contacting aluminum (Al) and a dispersing material in a reaction container and infiltrating molten aluminum (Al) into pores inside said mixed material, thereby a dispersing material is dispersed in a matrix, wherein the composite material is producible by steps of filling said mixed material in a space forming region to be defined by at least two container elements when said at least two container elements are integrated into one body with said mixed material being filled; said container elements being used as a reaction container, and then infiltrating said aluminum (Al) which is molten due to heat generated by said self-combustion reaction into pores inside said mixed material through at least one hole formed in an upper part of a reaction container formed by combining said at least two container elements in which said mixed material is filled in said space forming region in a state being fixed to a predetermined shape, thereby an aluminide intermetallic compound is formed by the self-combustion reaction between said metal powder and said aluminum (Al), and a dispersing material is dispersed into said matrix.

2. The composite material according to claim 1, wherein a ratio of said aluminum (Al) being contained in said matrix to whole of said matrix is 60 mass % or less.

3. The composite material according to claim 1, wherein said metal powder is a powder comprising at least one member of metals selected from the group consisting of titanium (Ti), nickel (Ni), and niobium (Nb).

4. The composite material according to claim 1, wherein said hole is made of an annular member having a stress buffering effect.

5. The composite material according to claim 1, wherein said mixed material is filled in a lower part of an inner portion of said at least one hole.

6. The composite material according to claim 1, wherein a value (X/Y) of a ratio of an internal diameter (X) of said hole to a maximum infiltrated distance (Y) of said melt-infiltrated aluminum (Al) is 0.06 to 0.5.

7. The composite material according to claim 1, wherein a proportion (volume fraction) of said dispersing material in said whole composite material is 10 to 70% by volume.

8. The composite material according to claim 1, wherein said dispersing material is an inorganic material having at least one form selected from the group consisting of fiber, particle, and whisker.

9. The composite material according to claim 8, wherein said inorganic material is at least one kind selected from the group consisting of $Al_2O_3$, AlN, SiC, and $Si_3N_4$.

10. The composite material according to claim 1, wherein a ratio (%) of a mean particle diameter of said metal powder to a mean particle diameter of said dispersing material is 5 to 80%.

11. A method for producing a composite material producible by filling a mixed material containing a metal powder that can induce a self-combustion reaction upon contacting aluminum (Al) and a dispersing material in a reaction container and melt-infiltrating said aluminum (Al) into pores inside said mixed material to disperse the dispersing material in a matrix, wherein said method comprises steps of filling said mixed material in a space forming region to be defined by at least two container elements when said at least two container elements are integrated into one body with said mixed material being filled; said container elements being used as a reaction container, and then infiltrating said aluminum (Al) which is molten due to heat generated by said self-combustion reaction into pores inside said mixed material through at least one first hole formed in an upper part of a reaction container formed by combining said at least two container elements in which said mixed material is filled in said space forming region in a state being fixed to a predetermined shape, thereby an aluminide intermetallic compound is formed by the self-combustion reaction between said metal powder and said aluminum (Al), and a dispersing material is dispersed into said matrix.

12. The method for producing a composite material according to claim 11, wherein said metal powder is a powder comprising at least one member of metals selected from the group consisting of titanium (Ti), nickel (Ni), and niobium (Nb).

13. The method for producing a composite material according to claim 11, wherein when said metal powder is titanium (Ti) powder, a mass ratio of said melt-infiltrated aluminum (Al) to said titanium (Ti) powder (Al:Ti) is 1:0.17 to 1:0.57.

14. The method for producing a composite material according to claim 11, wherein when said metal powder is nickel (Ni) powder, a mass ratio of said melt-infiltrated aluminum (Al) to said nickel (Ni) powder (Al:Ni) is 1:0.20 to 1:0.72.

15. The method for producing a composite material according to claim 11, wherein when said metal powder is niobium (Nb) powder, a mass ratio of said melt-infiltrated aluminum (Al) to said niobium (Nb) powder (Al:Nb) is 1:0.27 to 1:1.13.

16. The method for producing a composite material according to claim 11, wherein said at lease one hole is formed of an annular member having a stress buffering effect.

17. The method for producing a composite material according to claim 11, wherein said mixed material is filled in a lower part of an inner portion of said at least one hole.

18. The method for producing a composite material according to claim 11, wherein a value (X/Y) of a ratio of an internal diameter (X) of said hole to a maximum infiltrated distance (Y) of said melt-infiltrated aluminum (Al) is 0.06 to 0.5.

19. The method for producing a composite material according to claim 11, wherein said dispersing material is an inorganic material having at least one kind of shape selected from the group consisting of fiber, particle, and whisker.

20. The method for producing a composite material according to claim 19, wherein said inorganic material is at least one kind selected from the group consisting of $Al_2O_3$, AlN, SiC, and $Si_3N_4$.

21. The method for producing a composite material according to claim 11, wherein a proportion (%) of a mean particle diameter of said metal powder to a mean particle diameter of said dispersing material is 5 to 80%.

22. The method for producing a composite material according to claim 11, wherein said reaction container is a container at least inner wall of which is composed of carbon material.

23. The method for producing a composite material according to claim 11, wherein said reaction container has a runner channel having a shape of a slope inclining toward a lower part from an upper part of said reaction container in a side part of said reaction container, and at least one second hole communicating with said runner channel, and said aluminum (Al) is melt-infiltrated through said first hole and said second hole(s) independently into pores inside of said mixed material, respectively.

24. The method for producing a composite material according to claim 11, wherein when said metal powder is titanium (Ti) powder and said dispersing material is particle (ceramic particle) comprising at least one kind of ceramics selected from the group consisting of AlN, Si, and $Si_3N_4$, a value (Ti/ceramics) of a ratio of a volume of said titanium (Ti) powder to a volume of said ceramic particle and a percentage (porosity (%)) of said pore to a volume of said space of said reaction container satisfy one of following relationships (1) through (6):

(1) $0.1 \leqq (Ti/ceramics) < 0.14$, $25 \leqq porosity\ (\%) \leqq 60$;

(2) $0.14 \leqq (Ti/ceramics) < 0.27$, $25 \leqq porosity\ (\%) \leqq 70$;

(3) $0.27 \leqq (Ti/ceramics) < 0.53$, $25 \leqq porosity\ (\%) \leqq 75$;

(4) $0.53 \leqq (Ti/ceramics) < 1$, $30 \leqq porosity\ (\%) \leqq 75$;

(5) $1 \leqq (Ti/ceramics) < 1.4$, $45 \leqq porosity\ (\%) \leqq 80$; and (6) $1.4 \leqq (Ti/ceramics) \leqq 2$, $50 \leqq porosity\ (\%) \leqq 80$.

25. The method for producing a composite material according to claim 11, wherein when said metal powder is titanium (Ti) powder and said dispersing material is $Al_2O_3$ particle, a value ($Ti/Al_2O_3$) of a ratio of a volume of said titanium (Ti) powder to a volume of said $Al_2O_3$ particle, and a percentage (porosity (%)) of said pore to a volume of said space of said reaction container satisfy one of following relationships (7) through (12):

(7) $0.1 \leqq (Ti/Al_2O_3) < 0.14$, $25 \leqq$ porosity (%) $\leqq 60$;

(8) $0.14 \leqq (Ti/Al_2O_3) < 0.27$, $25 \leqq$ porosity (%) $\leqq 70$;

(9) $0.27 \leqq (Ti/Al_2O_3) < 0.53$, $25 \leqq$ porosity (%) $\leqq 75$;

(10) $0.53 \leqq (Ti/Al_2O_3) < 1$, $30 \leqq$ porosity (%) $\leqq 75$;

(11) $1 \leqq (Ti/Al_2O_3) < 1.4$, $45 \leqq$ porosity (%) $\leqq 80$; and

(12) $1.4 \leqq (Ti/Al_2O_3) \leqq 2$, $50 \leqq$ porosity (%) $\leqq 80$.

* * * * *